US011450263B2

(12) United States Patent
Lim et al.

(10) Patent No.: US 11,450,263 B2
(45) **Date of Patent: *Sep. 20, 2022**

(54) METHOD OF OPERATING SOURCE DRIVER, DISPLAY DRIVING CIRCUIT, AND METHOD OF OPERATING DISPLAY DRIVING CIRCUIT

(71) Applicant: SAMSUNG ELECTRONICS CO., LTD., Suwon-si (KR)

(72) Inventors: Hyun-wook Lim, Seoul (KR); Kwi-sung Yoo, Yongin-si (KR); Young-min Choi, Yongin-si (KR); Jae-youl Lee, Hwaseong-si (KR); Dong-hoon Baek, Seoul (KR); Kyong-ho Kim, Hwaseong-si (KR); Eun-young Jin, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/113,713

(22) Filed: Dec. 7, 2020

(65) Prior Publication Data

US 2021/0118356 A1 Apr. 22, 2021

Related U.S. Application Data

(63) Continuation of application No. 15/262,506, filed on Sep. 12, 2016, now Pat. No. 10,861,375.

(30) Foreign Application Priority Data

Nov. 6, 2015 (KR) ..... 10-2015-0155793

(51) Int. Cl.
*G09G 3/20* (2006.01)
*G09G 5/00* (2006.01)

(52) U.S. Cl.
CPC ..... *G09G 3/2092* (2013.01); *G09G 5/006* (2013.01); *G09G 2300/0809* (2013.01);
(Continued)

(58) Field of Classification Search
None
See application file for complete search history.

(56) References Cited

U.S. PATENT DOCUMENTS 3,978,407 A 8/1976 Forney, Jr. et al.
6,671,314 B1 12/2003 Abe et al.
(Continued)

FOREIGN PATENT DOCUMENTS

KR 10-0340178 B1 6/2002
KR 10-0498465 B1 7/2005
(Continued)

OTHER PUBLICATIONS

Communication dated Oct. 22, 2021, issued by the Korean Intellectual Property Office in Korean Application No. 10-2015-0155793.
(Continued)

*Primary Examiner* — Christopher R Lamb
(74) *Attorney, Agent, or Firm* — Sughrue Mion, PLLC

(57) ABSTRACT

A method of operating a source driver, a display driving circuit, and a method of operating the display driving circuit are provided. The method of operating the source driver including a receiver, includes determining a parameter value of the receiver for optimizing a receiving of the receiver, through training, and transmitting the parameter value to a timing controller external to the source driver. The method of operating the source driver further includes, based on an abnormal state occurring in the receiving of the receiver, receiving the transmitted parameter value from the timing
(Continued)

controller, and optimizing the receiving of the receiver based on the received parameter value.

19 Claims, 23 Drawing Sheets

(52) U.S. Cl.
CPC . *G09G 2310/0286* (2013.01); *G09G 2310/08* (2013.01); *G09G 2370/08* (2013.01)

(56) References Cited

U.S. PATENT DOCUMENTS

| | | | |
|---|---|---|---|
| 6,823,489 | B2 | 11/2004 | Wittig et al. |
| 7,158,566 | B2 | 1/2007 | Dowling |
| 7,190,720 | B2 | 3/2007 | Fimoff et al. |
| 7,535,954 | B2 | 5/2009 | Kim et al. |
| 7,852,915 | B2 | 12/2010 | Chen |
| 8,532,504 | B2 | 9/2013 | Wagner et al. |
| 8,588,359 | B2 | 11/2013 | Kibune |
| 8,711,916 | B2 | 4/2014 | Zhu |
| 8,718,126 | B2 | 5/2014 | Cheung |
| 10,861,375 | B2 * | 12/2020 | Lim ..... G09G 3/2092 |
| 2008/0252504 | A1 | 10/2008 | Jeong et al. |
| 2012/0056870 | A1 | 3/2012 | Koh |
| 2013/0057763 | A1 | 3/2013 | Cha et al. |
| 2013/0076703 | A1 | 3/2013 | Baek et al. |
| 2013/0101011 | A1 | 4/2013 | Shin et al. |
| 2013/0113777 | A1 | 5/2013 | Baek et al. |
| 2014/0078133 | A1 | 3/2014 | Lee et al. |
| 2014/0176238 | A1 | 6/2014 | Guo et al. |
| 2016/0284300 | A1 | 9/2016 | Park et al. |
| 2016/0341780 | A1 | 11/2016 | McLeod et al. |

FOREIGN PATENT DOCUMENTS

| | | | |
|---|---|---|---|
| KR | 10-0937509 | B1 | 1/2010 |
| KR | 10-2011-0021386 | A | 3/2011 |
| KR | 10-2013-0051182 | A | 5/2013 |
| WO | 01/97475 | A1 | 12/2001 |

OTHER PUBLICATIONS

Communication dated May 2, 2022 issued by the Korean Patent Office in KR Application No. 10-2015-0155793.

* cited by examiner

METHOD OF OPERATING SOURCE DRIVER, DISPLAY DRIVING CIRCUIT, AND METHOD OF OPERATING DISPLAY DRIVING CIRCUIT

CROSS-REFERENCE TO RELATED APPLICATION

This is a Continuation Application of U.S. application Ser. No. 15/262,506, filed on Sep. 12, 2016, which claims priority from Korean Patent Application No. 10-2015-0155793, filed on Nov. 6, 2015, in the Korean Intellectual Property Office, the disclosures of which are incorporated herein by reference in their entireties.

BACKGROUND

1. Field

Methods and apparatus consistent with example embodiments relate to a display driving circuit, and more particularly, to a method of operating a source driver, a display driving circuit, and a method of operating the display driving circuit.

2. Description of the Related Art

As the resolution and color depth of a display panel increase, a transmission speed of display data transmitted between circuits included in a display driving circuit increases. Accordingly, as a gain degradation of a signal transmitted and received through a data transmission channel increases, various technologies have been studied to compensate for the gain degradation of the signal. In addition, there is a need for a technology of compensating for the gain degradation of the signal without reducing an operation speed of a display device.

SUMMARY

Example embodiments provide a source driver that efficiently increases a receiving performance without reducing an operation speed and a method of operating the source driver.

Example embodiments provide a display driving circuit that increases a receiving performance of a source driver without reducing an operation speed and a method of operating the display driving circuit.

According to example embodiments, there is provided a method of operating a source driver including a receiver, the method including determining a parameter value of the receiver for optimizing a receiving of the receiver, through training, and transmitting the parameter value to a timing controller external to the source driver. The method further includes, based on an abnormal state occurring in the receiving of the receiver, receiving the transmitted parameter value from the timing controller, and optimizing the receiving of the receiver based on the received parameter value.

The parameter value may be determined in a first initialization period based on power being supplied to the source driver.

The parameter value may be determined periodically at preset time intervals.

The parameter value may include an equalization coefficient of the receiver.

The parameter value may include an offset compensation voltage for compensating for an output offset of a comparator included in the receiver.

The method may further include receiving, from the timing controller, a read command for the parameter value, and the parameter value may be transmitted based on the receiving the read command.

The method may further include converting the parameter value into packet data, and transmitting, to the timing controller, the packet data as the parameter value.

The parameter value may be transmitted in a display period.

The timing controller may be connected to the source driver through a main link and an auxiliary link, the method may further include receiving display data from the timing controller through the main link, and the parameter value may be transmitted through the auxiliary link.

The method may further include, based on the abnormal state occurring, transmitting a state information signal indicating the abnormal state to the timing controller through the auxiliary link.

The method may further include, based on the abnormal state occurring, recovering a system clock of the receiver through another training before the receiving the transmitted parameter value.

According to example embodiments, there is provided a display driving circuit including a source driver configured to determine a parameter value for optimizing a receiving of the source driver, through training, and a timing controller configured to receive the parameter value from the source driver through a share back channel, and based on an abnormal state occurring in the receiving of the source driver, transmit the received parameter value to the source driver.

The source driver may be further configured to receive, from the timing controller, a read command for the parameter value, and transmit the parameter value to the timing controller based on the reception of the read command. Read commands may be included in a configuration field of a packet data that is received from the timing controller through a data transmission channel.

The timing controller may be further configured to sequentially transmit the read commands for parameter values to respective source drivers.

The parameter value may be received in a display period.

The source driver may be further configured to optimize the receiving of the source driver based on the transmitted parameter value.

The source driver may be further configured to transmit a state information signal indicating the abnormal state to the timing controller through the share back channel.

The source driver may include a comparator configured to receive a differential signal pair from the timing controller through a data transmission channel, an offset compensation circuit configured to compensate for an output offset of the comparator, and an equalizer configured to adjust a gain of a receive signal to compensate for a distortion of the receive signal due to the data transmission channel.

The parameter value may include at least one among an offset compensation voltage that is generated by the offset compensation circuit for compensating the output offset of the comparator, an equalization coefficient of the equalizer, and a resistance of a variable resistor for impedance matching of the comparator.

The parameter value may be determined in a first initialization period based on power being supplied to the source driver, or may be determined periodically at preset time intervals.

According to example embodiments, there is provided a method of operating a display driving circuit including a timing controller and a source driver, the method including determining, by the source driver, a parameter value for optimizing a receiving of the source driver, through training, first-transmitting, by the source driver, the parameter value to the timing controller based on receiving a read command from the timing controller, second-transmitting, by the timing controller, the first-transmitted parameter value to the source driver based on receiving a first signal from the source driver, and optimizing, by the source driver, the receiving of the source driver based on the second-transmitted parameter value.

The method may further include transmitting, by the source driver, the first signal to the timing controller based on an abnormal state occurring in the receiving of the source driver.

The read command may be received through a first channel, and the parameter value may be first-transmitted through a second channel.

The read command may be received and the parameter value may be first-transmitted in a display period.

According to example embodiments, there is provided a system for a display panel, the system including a transmitter, and a receiver configured to determine a parameter value for optimizing a receiving of the receiver, through a first training, receive, from the transmitter, a read command for the parameter value, first-transmit the parameter value to the transmitter based on the reception of the read command, and transmit, to the transmitter, a state information signal indicating an abnormal state of the receiving of the receiver, recover a system clock of the receiver through a second training, and transmit, to the transmitter, the state information signal indicating a data receiving state of the receiving of the receiver, based on the abnormal state occurring. The transmitter may be configured to transmit the first-transmitted parameter value to the source driver based on the transmission of the state information signal indicating the data receiving state, and the receiver may be further configured to optimize the receiving of the receiver based on the second-transmitted parameter value.

The transmitter may be a timing controller of the display panel, the timing controller being configured to transmit, to the receiver, a reset signal and a frame synchronization signal, and the receiver may be a source driver of the display panel, the source driver being configured to recover the system clock of the source driver through the second training, and transmit, to the timing controller, the state information signal indicating the data receiving state, based on the transmission of the reset signal or the frame synchronization signal.

The transmitter may be a processor of a device on which the display panel is disposed, and the receiver may be a timing controller of the display panel, the timing controller being connected to a source driver of the display panel.

BRIEF DESCRIPTION OF THE DRAWINGS

The above and/or other aspects will be more apparent by describing example embodiments with reference to the accompanying drawings in which.

DETAILED DESCRIPTION

Figure 1:
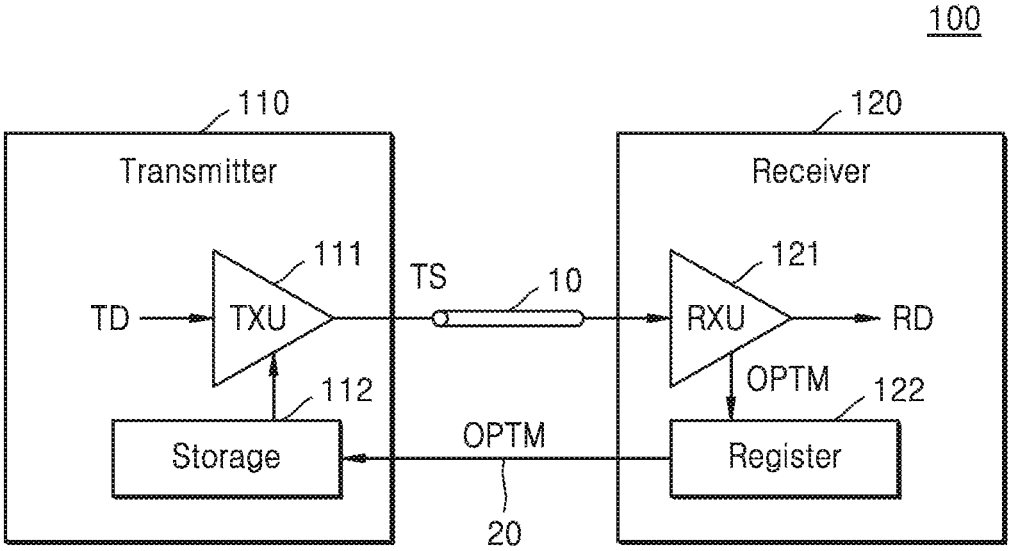
FIG. 1 is a block diagram of a transmitting and receiving system according to example embodiments.

Example embodiments will now be described more fully hereinafter with reference to the accompanying drawings. These example embodiments are provided so that this disclosure is thorough and complete and fully conveys the scope of the inventive concept to one skilled in the art. Accordingly, while the inventive concept can be modified in various ways and take on various alternative forms, the example embodiments thereof are shown in the drawings and described in detail below as examples. There is no intent to limit the example embodiments to the forms disclosed. On the contrary, the example embodiments are to cover all modifications, equivalents, and alternatives falling within the spirit and scope of the appended claims. Like reference numerals refer to like elements throughout.

It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

As used herein, the term "or" includes any and all combinations of one or more of the associated listed items. For example, the expression "A or B" may include A, B, or both A and B.

It will be understood that, although the terms first, second, etc. may be used herein to describe various elements, components, regions, layers and/or sections, these elements, components, regions, layers and/or sections may not be limited by these terms. Thus, a first element, component, region, layer or section discussed below could be termed a second element, component, region, layer or section without departing from the teachings of the example embodiments.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements.

The terminology used herein is for the purpose of describing example embodiments only and is not intended to be limiting of example embodiments. As used herein, the singular forms "a," "an," and "the" are intended to include the plural forms as well, unless the context clearly indicates otherwise.

Unless otherwise defined, all terms (including technical and scientific terms) used herein have the same meaning as commonly understood by one of ordinary skill in the art to which these example embodiments belong. It will be further understood that terms, such as those defined in commonly used dictionaries, may be interpreted as having a meaning that is consistent with their meaning in the context of the relevant art and will not be interpreted in an idealized or overly formal sense unless expressly so defined herein. Expressions such as "at least one among," when preceding a list of elements, modify the entire list of elements and do not modify the individual elements of the list.

FIG. 1 is a block diagram of a transmitting and receiving system 100 according to example embodiments. The transmitting and receiving system 100 may be applied to a display device, an audio device, a home network, a broadcast network, a wired or wireless communication system, etc. The transmitting and receiving system 100 may be applied to various other electronic systems.

Referring to FIG. 1, the transmitting and receiving system 100 includes a transmitter 110, a receiver 120, and channels 10 and 20. The channels 10 and 20 may be respectively referred to as a first channel 10 and a second channel 20. The first channel 10 may be a data transmission channel used by the transmitter 110 to transmit data to the receiver 120. The second channel 20 may be a state transmission channel used by the receiver 120 to transmit a receiving state to the transmitter 110. The first channel 10 may be referred to as a main link. The second channel 20 may be referred to as an auxiliary link.

The transmitter 110 transmits transmission data TD to the receiver 120 depending on an interface scheme of the transmitting and receiving system 100. For example, when the transmitting and receiving system 100 is mounted on a display device, the transmission data TD may include display data.

The transmitter 110 includes a transmission unit 111 (TXU) and a storage 112. The transmission unit 111 may convert the transmission data TD and a clock signal into a transmission signal TS according to the interface scheme and characteristics of the first channel 10, and provides the transmission signal TS to the first channel 10.

In example embodiments, the transmission unit 111 may perform a serial conversion on the transmission data TD according to the interface scheme. The transmission unit 111 may also transmit the clock signal by embedding the clock signal in the transmission signal TS. The transmission unit 111 may convert the transmission data TD into packet data.

In example embodiments, when the first channel 10 includes two signal lines, the transmission unit 111 may transmit the transmission signal TS including a differential signal pair through the two signal lines.

In example embodiments, the interface scheme may be one selected from a universal serial interface (USI), a central processing unit (CPU) interface, an RGB interface, a mobile industry processor interface (MIPI), a mobile display digital interface (MDDI), a compact display port (CDP), a mobile pixel link (MPL), a current mode advanced differential signaling (CMADS), a serial peripheral interface (SPI), an inter-integrated circuit (I2C) interface, a display-port (DP) and embedded display-port (eDP) interface, a camera control interface (CCI), a camera serial interface (CSI), a micro controller unit (MCU) interface, a high definition multimedia interface (HDMI), and an intra panel interface (IPI). Besides, the interface scheme may be one among various high speed serial interface schemes.

The storage 112 may store various types of data for an operation of the transmitter 110. The storage 112 may also store data provided from the receiver 120. In example embodiments, the storage 112 may store data transmitted from the receiver 120 through the second channel 20.

The receiver 120 receives data transmitted from the transmitter 110. The receiver 120 includes a receiving unit 121 (RXU) and a register 122. The receiving unit 121 receives the transmission signal TS through the first channel 10 and may recover receive data RD and a system clock from the transmission signal TS.

During an initialization period after power is supplied to the transmitting and receiving system 100, the receiving unit 121 may recover the system clock through training and may perform an optimization operation for improving receive performance.

The receiving unit 121 may include various elements such as an equalizer, a comparator, an impedance matching unit, etc. and determines a parameter value OPTM for optimizing states of the elements through training in a first initialization period suitable for a receiving environment (for example, impedance of a data transmission channel, a transmission speed of a receive signal, etc.). For example, a parameter may include an equalization parameter of the equalizer, a level of a compensation voltage for compensating for an offset of the comparator, a resistance level of a variable resistor for impedance matching, etc.

If training starts, the receiving unit 121 may test a receiving operation by applying, to the parameter, various values starting from a default value within a dynamic range. Thus, the receiving unit 121 determines the parameter value OPTM optimizing the receiving operation. The register 122 may store the parameter value OPTM.

The receiver 120 may transmit the parameter value OPTM stored in the register 122 to the transmitter 110. In example embodiments, the receiver 120 transmits the parameter value OPTM to the transmitter 110 through the second channel 20.

The transmitter 110 may store the parameter value OPTM received from the receiver 120 in the storage 112, and, afterwards, if a signal requesting the parameter value OPTM is received from the receiver 120 or a receive state of the receiver 120 is determined to be defective, may retransmit the parameter value OPTM to the receiver 120. The transmitter 110 may transmit the parameter value OPTM to the receiver 120 through the first channel 10. In example embodiments, the transmitter 110 may determine the receive state of the receiver 120 through a level change of a state signal received through the second channel 20.

The receiver 120 may optimize the receiving unit 121 again based on the parameter value OPTM received from the transmitter 110 without training after recovering the system clock.

As described above, the parameter value OPTM may be stored in the register 122 of the receiver 120. In this regard, the parameter value OPTM stored in the register 122 may be changed when the receiver 120 is reset or due to an electrostatic discharge (ESD). Because the parameter value OPTM is changed, the receiver 120 may not normally receive data. Thus, the receiving unit 121 may be optimized by recovering the system clock through training and re-determining the parameter value OPTM. However, when the parameter value OPTM is re-determined through training, a lot of time may be consumed for optimization of the receiving unit 121.

In the transmitting and receiving system 100 according to example embodiments, the receiver 120 may store the determined parameter value OPTM of the receiving unit 121 in the storage 112 provided in the transmitter 110, afterwards, when optimization of the receiving operation of the receiving unit 121 is to be performed, receive the parameter value OPTM from the transmitter 110, and optimize the receiving operation of the receiving unit 121. The receiver 120 may not re-determine the parameter value OPTM but receive the parameter value OPTM stored in the transmitter 110 to optimize the receiving operation, and thus time and current consumed to optimize the receiving operation may be reduced. The receiver 120 may normally receive data without a reduction in an operation speed. Accordingly, the transmitting and receiving system 100 according to example embodiments may improve transmitting and receive performance.

Figure 2:
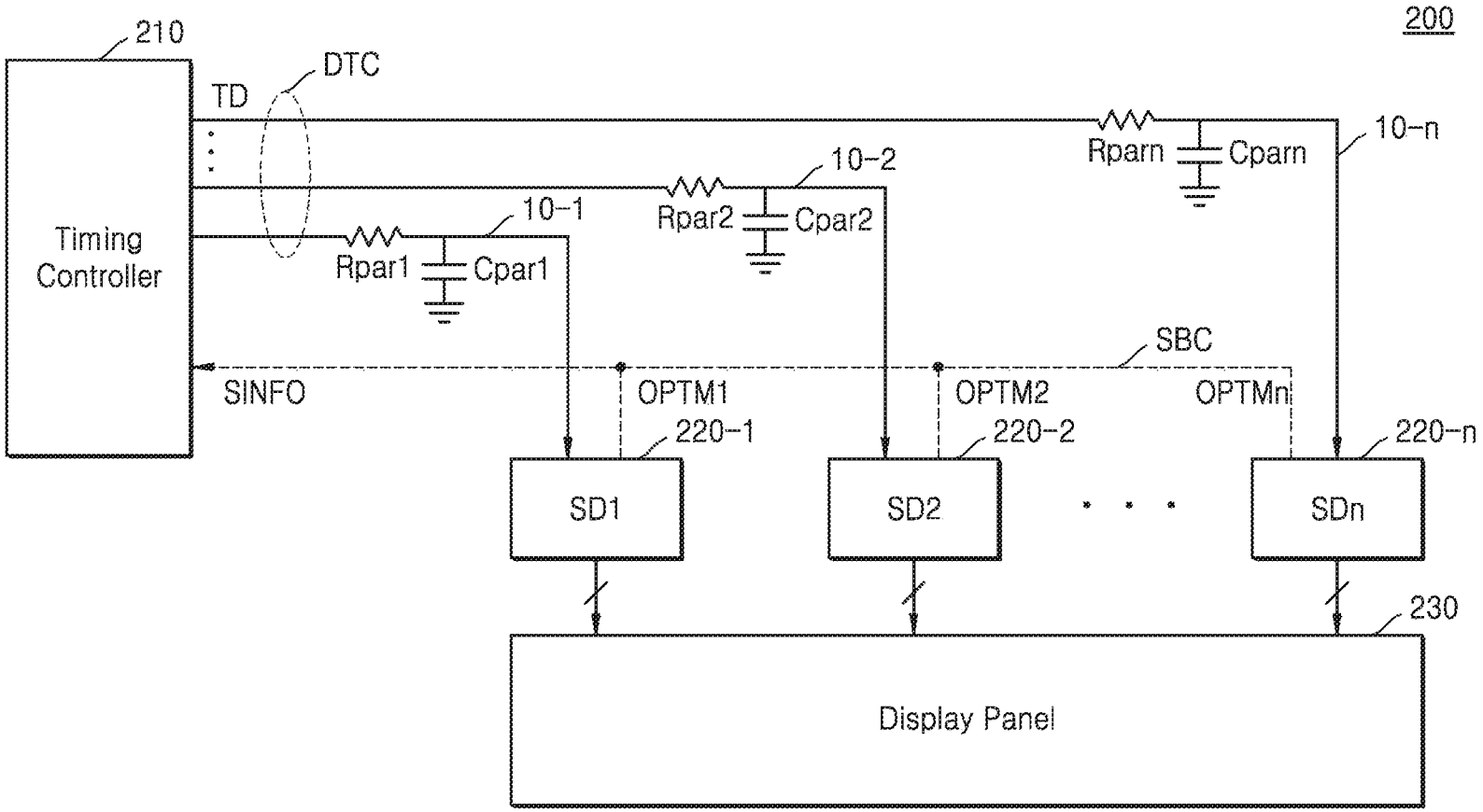
FIG. 2 is a block diagram of a display driving circuit according to example embodiments.

FIG. 2 is a block diagram of a display driving circuit 200 according to example embodiments. FIG. 2 shows the display driving circuit 200 to which the transmitting and receiving system 100 of FIG. 1 is applied. A method of operating the transmitting and receiving system 100 described with reference to FIG. 1 may be applied to the display driving circuit 200. For convenience of description, a display panel 230 is illustrated together.

Referring to FIG. 2, the displaying driving circuit 200 includes a timing controller 210, a plurality of source drivers **220-1~220-*n*** (SDs), a data transmission channel DTC, and a share back channel SBC.

The timing controller 210 may transmit data to the plurality of source drivers **220-1~220-*n*. The data transmitted to the plurality of source drivers 220-1~220-*n* may be packet data including display data. Each of the plurality of source drivers 220-1~220-*n* may drive one or more data lines DL1~DLm of the display panel 230** based on the received data.

The timing controller 210 may transmit and receive data with the plurality of source drivers **220-1~220-*n* through a high speed serial interface scheme according to example embodiments. An interface scheme between the timing controller 210 and the plurality of source drivers 220-1~220-*n* may be an IPI. A method of operating the display driving circuit 200** according to the high speed serial interface scheme of example embodiments will now be described below.

The timing controller 210 may be connected to the plurality of source drivers **220-1~220-*n* in a point-to-point manner and may transmit data to each of the plurality of source drivers 220-1~220-*n* through different data transmission channels DTCs. The timing controller 210 may transmit the data to the first source driver 220-1 through a first transmission channel 10-1 and to the second source driver 220-2 through a second transmission channel 10-2. Accordingly, the data may be transmitted to each of the n (n is an integer greater than or equal to 2) source drivers 220-1~220-*n*** through *n* transmission channels 10-1 to **10-*n*. Each of the first through nth transmission channels 10-1 to 10-*n*** may include a plurality of signal lines.

Distances between the timing controller 210 and the plurality of source drivers **220-1~220-*n* may be different from each other. Thus, lengths of the transmission channels 10-1 to 10-*n* may be different from each other, and parasitic resistances Rpar1 to Rpam of the transmission channels 10-1 to 10-*n* and parasitic capacitances Cpar1 to Cpam of the transmission channels 10-1 to 10-*n* may be different from each other. Accordingly, impedance and frequency characteristics of the transmission channels 10-1 to 10-*n* are different from each other, and thus, the plurality of source drivers 220-1~220-*n* may perform training for optimizing a receiving operation according to impedance and frequency characteristics of transmission channels corresponding thereto. In more detail, each of the plurality of source drivers 220-1~220-*n* may optimize the receiving operation of a receiving unit through training. The plurality of source drivers 220-1~220-*n* respectively determine parameter values OPTM1, OPTM2, . . . , OPTMn of the receiving unit optimizing the receiving operation and transmit the parameter values OPTM1, OPTM2, . . . , OPTMn to the timing controller 210. In example embodiments, the plurality of source drivers 220-1~220-*n* may respectively transmit the parameter values OPTM1, OPTM2, . . . , OPTMn to the timing controller 210 in response to (i.e., based on) a read command received from the timing controller 210**.

The plurality of source drivers **220-1~220-*n* may be connected to the timing controller 210 in a multi-drop manner through the share back channel SBS. In example embodiments, the share back channel SBS may be configured as one signal line. The plurality of source drivers 220-1~220-*n* may sequentially transmit the parameter values OPTM1, OPTM2, . . . , OPTMn to the timing controller 210 to the timing controller 210 through the share back channel SBC. At least one among the plurality of source drivers 220-1~220-*n* may transmit a state information signal SINFO indicating an abnormal state in connection with a receiving operation, i.e., when a receive abnormality state occurs, to the timing controller 210** through the share back channel SBC.

The timing controller 210 may store the parameter values OPTM1, OPTM2, . . . , OPTMn transmitted from the plurality of source drivers **220-1~220-*n*. When initialization and optimization of the plurality of source drivers 220-1~220-*n* are to be performed, for example, the state information signal SINFO indicating the abnormal state is received through the share back channel SBC, the timing controller 210 may respectively transmit to the parameter values OPTM1, OPTM2, . . . , OPTMn to the plurality of source drivers 220-1~220-*n*. The timing controller 210 may respectively transmit the parameter values OPTM1, OPTM2, . . . , OPTMn to the plurality of source drivers 220-1~220-*n* through the data transmission channel DTC. The plurality of source drivers 220-1~220-*n* may optimize the receiving operation of the receiving unit again based on the respectively transmitted parameter values OPTM1, OPTM2**, . . . , OPTMn.

As described above, according to the display driving circuit 200 and an interface scheme according to example embodiments, the plurality of source drivers 220-1~220-*n* may optimize the receiving operation of the receiving unit through training, thereby improving transmitting and receive performance of the display driving circuit 200. The plurality of source drivers 220-1~220-*n* may store the parameter values OPTM1, OPTM2, . . . , OPTMn of the receiving unit that are determined according to optimization When optimization of the receiving operation is to be performed, without re-determining the parameter values OPTM1, OPTM2, . . . , OPTMn, the plurality of source drivers 220-1~220-*n* may optimize the receiving operation based on the parameter values OPTM1, OPTM2, . . . , OPTMn provided from the timing controller 210, thereby reducing time consumed to optimize the receiving operation. The plurality of source drivers 220-1~220-*n* may minimize the number of times used to determine the parameter values OPTM1, OPTM2, . . . , OPTMn of the receiving unit, thereby reducing power consumed by the plurality of source drivers 220-1~220-*n*.

Figure 3:
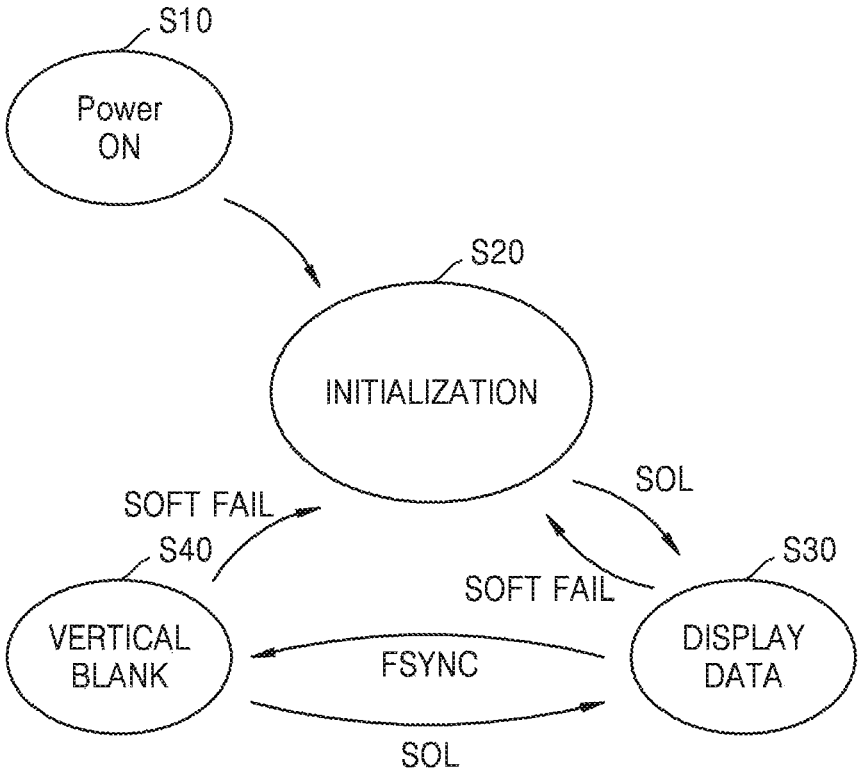
FIG. 3 is a state diagram illustrating an operation mode of a display driving circuit, according to example embodiments.

FIG. 3 is a state diagram illustrating an operation mode of the display driving circuit 200, according to example embodiments. The operation mode of FIG. 3 may refer to the display driving circuit 200 of FIG. 2.

Referring to FIGS. 2 and 3, the operation mode of the display driving circuit 200 includes an initialization mode S20, a display data mode S30, and a vertical blank mode S40. A period in which the display driving circuit 200 operates in the initialization mode S20 may be referred to as an initialization period. A period in which the display driving circuit 200 operates in the display data mode S30 or the vertical blank mode S40 may be referred to as a display period.

When the display driving circuit 200 operates in the initialization mode S20, the display driving circuit 200 may perform first initialization or second initialization. When the display driving circuit 200 performs first initialization, the plurality of source drivers 220-1~220-*n* may perform full initialization and optimization of a receiving unit. When the display driving circuit 200 performs second initialization, the plurality of source drivers 220-1~220-*n* may perform partial initialization of the receiving unit. For example, when the display driving circuit 200 performs first initialization, the plurality of source drivers 220-1~220-*n* may perform DC training and AC training based on a training pattern that is provided from the timing controller 210. DC training may optimize a receive characteristic of the receiving unit irrespective of the outside, for example, a signal received from the timing controller 210, and may include, for example, impedance matching, offset calibration, etc. AC training may optimize the receive characteristic based on the training pattern received from the timing controller 210 and may include, for example, a system clock recovery, an equalization parameter determination, etc. The plurality of source drivers 220-1~220-*n* may initialize and optimize the receiving unit through first initialization and may determine a parameter value of the receiving unit. When the display driving circuit 200 performs second initialization, the plurality of source drivers 220-1~220-*n* may perform partial initialization during AC training. For example, the plurality of source drivers 220-1~220-*n* may recover a system clock by performing clock recovery training.

In example embodiments, first initialization may be performed during a first initialization period after power is supplied to the display driving circuit 200. In example embodiments, first initialization may be performed periodically at a preset time units or intervals or according to a preset condition.

The display driving circuit 200 may perform first initialization if the display driving circuit 200, e.g., the timing controller 210 and the plurality of source drivers 220-1~220-*n*, is powered on S10. Each of the plurality of source drivers 220-1~220-*n* may optimize the receiving unit through training, e.g., DC training and AC training, and may store the parameter value of the receiving unit in an internally provided register.

Thereafter, the display driving circuit 200 operates in the display data mode S30. The timing controller 210 may inform a start of the display data mode S30 by transmitting a data packet including a start of line SOL to the plurality of source drivers 220-1~220-*n* in the display period. The timing controller 210 may transmit display data corresponding to each of lines of an image frame to each of the plurality of source drivers 220-1~220-*n*. In this regard, the timing controller 210 may sequentially transmit the display data and a read command requesting to read the parameter value to the plurality of source drivers 220-1~220-*n*. A source driver that received the read command may transmit the parameter value stored in the register to the timing controller 210. The timing controller 210 may store the received parameter value.

When the display data corresponding to one image frame is transmitted, the display driving circuit 200 operates in the vertical blank mode S40. The timing controller 210 may inform an end of the display data mode S30 by transmitting display data including a frame synchronization signal FSYNC to the plurality of source drivers 220-1~220-*n*.

In example embodiments, during the vertical blank mode S40, the display driving circuit 200 may perform second initialization. The timing controller 210 may transmit a training pattern to each of the plurality of source drivers 220-1~220-*n*. Each of the plurality of source drivers 220-1~220-*n* may perform system clock recovery training based on the training pattern.

The display data mode S30 and the vertical blank mode S40 may be repeatedly performed for each image frame. The display data mode S30 and the vertical blank mode S40 may be repeatedly performed until the display driving circuit 200 is powered off or a soft fail (SOFT FAIL) occurs in one among the plurality of source drivers 220-1~220-*n*. When the operation mode of the display driving circuit 200 is changed from the vertical blank mode S40 to the display data mode S30, the timing controller 210 may transmit packet data including the line start field SOL to the plurality of source drivers 220-1~220-*n*. When the operation mode of the display driving circuit is changed from the display data mode S30 to the vertical blank mode S40, the timing controller 210 may transmit packet data including the frame synchronization signal FSYNC to the plurality of source drivers 220-1~220-*n*.

When the soft fail occurs in at least one among the plurality of source drivers 220-1~220-*n* in the display period, the display driving circuit 200 may perform initialization. The soft fail may occur, for example, when a wrong system clock is output because a clock recovery circuit included in a receiving unit is in an unlock state or when an inner setting value of the receiving unit is changed due to an ESD.

In this regard, the plurality of source drivers **220-1~220-*n* may recover a system clock by performing second initialization and may optimize a receiving operation of the receiving unit based on the parameter value received from the timing controller 210. Each of the plurality of source drivers 220-1~220-*n* may recover the system clock based on the training pattern received from the timing controller 210. The timing controller 210 may transmit the parameter value stored in the display data mode S30 to the plurality of source drivers 220-1~220-*n*. The timing controller 210 may provide the parameter value corresponding to each of the plurality of source drivers 220-1~220-*n*. Each of the plurality of source drivers 220-1~220-*n* may promptly optimize the receiving operation of the receiving unit based on the received parameter value. Thereafter, the display driving circuit 200 may operate in the display data mode S30**.

Figure 4:
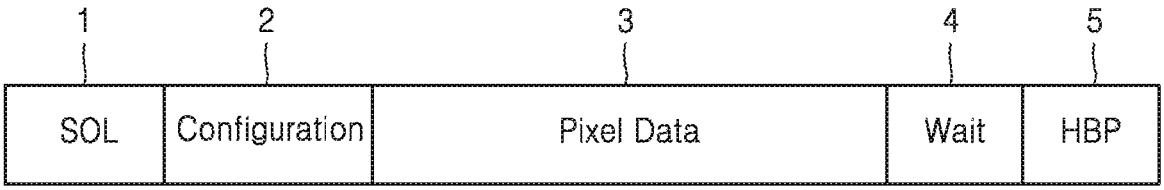
FIG. 4 is a diagram of packet data according to example embodiments.

FIG. 4 is a diagram of packet data PKDT according to example embodiments.

Referring to FIG. 4, the packet data PKDT includes a start of line (SOL) field 1, a configuration field 2, a pixel data field 3, a wait field 4, and a horizontal blank field (HBP) 5.

The start of line field 1 indicates a start of each line of an image frame displayed on the display panel 230. A source driver may identify the configuration field 2, the pixel data field 3, and the wait field 4 based on a counting result of the counter by operating an internal counter in response to (i.e., based on) the start of line field 1. The start of line field 1 may include a code having an edge or pattern to identify the horizontal blank field 5 with respect to a previous line of a current image frame or a vertical blank period between the current image frame and a previous image frame.

The configuration field 2 may include configuration data for controlling the source driver. The configuration data may include frame configuration data for controlling frame setting of the image frame or line configuration data for controlling setting of each line. In example embodiments, a read command or a parameter value of a receiving unit of the source driver may be included in the configuration data. The configuration data may include a frame synchronization signal activated when a data packet with respect to a final list of the image frame is transmitted. The source driver may know a start of the vertical blank period after a current data packet is received by receiving the activate frame synchronization signal. Besides, the configuration data may include various types of control data.

The pixel data field 3 may include display data, i.e., pixel data. The pixel data field 3 may further include CRC data for detecting and correcting an error.

The wait field 4 may be a period allocated for the source driver to secure time taken to receive and store the display data. For example, the wait field 4 may have a bit number corresponding to the time for the source driver to receive and store the display data in a latch 243 of FIG. 15.

The horizontal blank field 5 may be a period allocated for the source driver to secure time taken to drive the display panel 230 based on the display data. For example, the horizontal blank field 5 may convert the display data stored in the data latch into an analog voltage and may have a bit number corresponding to time taken to apply the analog voltage to the display panel 230.

Figure 5:
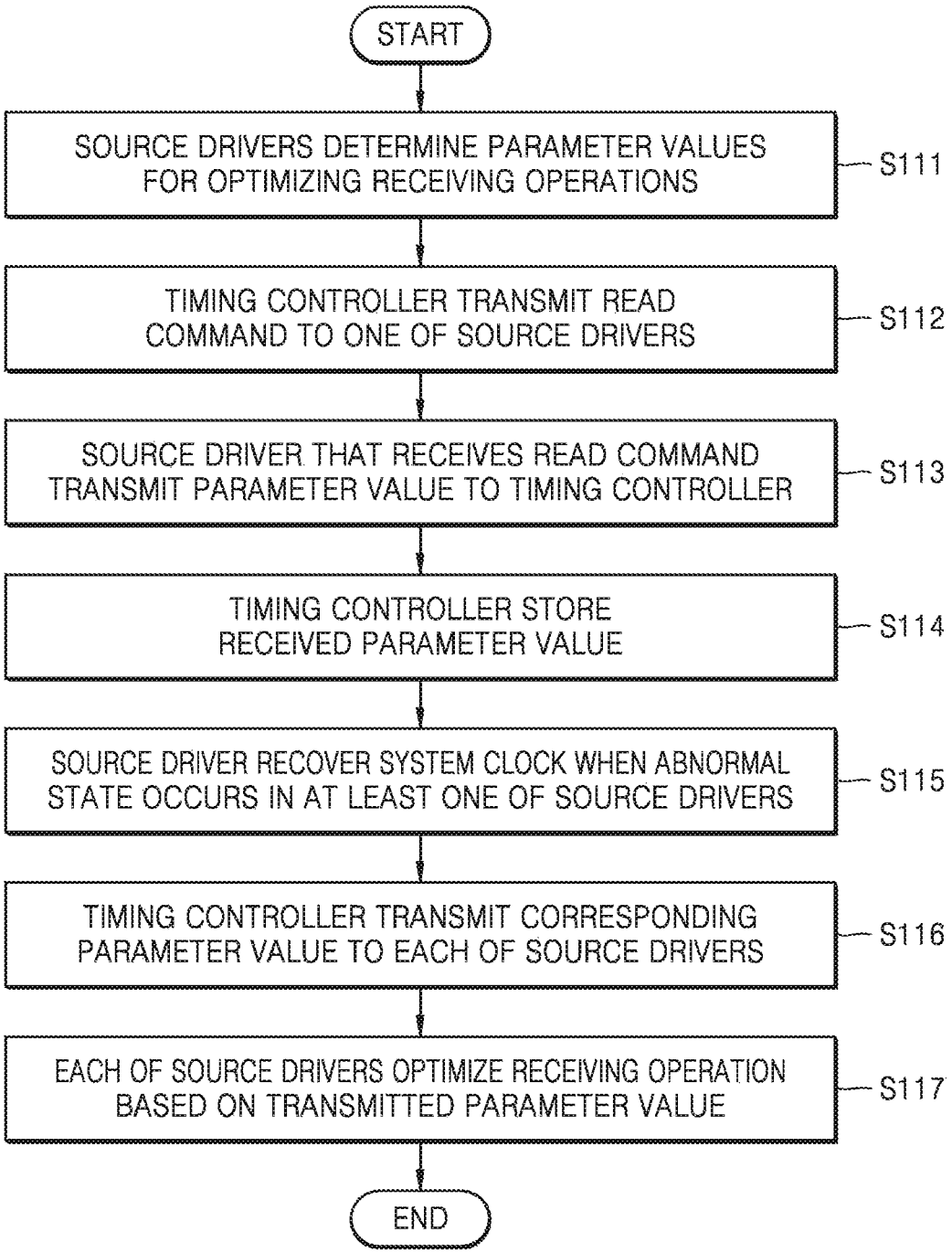
FIG. 5 is a flowchart of a method of operating a display driving circuit according to example embodiments.

FIG. 5 is a flowchart illustrating a method of operating a display driving circuit according to example embodiments. The method of FIG. 5 is an example of a method of operating the display driving circuit 200 of a display device of FIG. 2. Thus, the method of operating the display driving circuit 200 described with reference to FIG. 2 may be applied to the example embodiments.

Referring to FIGS. 2 and 5, the plurality of source drivers **220-1~220-*n* determine parameter values for optimizing receiving operations (operation S111). The parameter value may be a parameter value of a receiving unit provided in each of the plurality of source drivers 220-1~220-*n*. As described with reference to FIG. 3 above, the parameter value may be determined in a first initialization operation. The plurality of source drivers 220-1~220-*n* may optimize the receiving operation of the receiving unit and may determine the parameter value of the receiving unit optimizing the receiving operation through training. Each of the plurality of source drivers 220-1~220-*n*** may store the parameter value in an internally provided register.

The timing controller 210 transmits a read command to one of the plurality of source drivers **220-1~220-*n* (operation S112). The read command may be a signal requesting to read the parameter value from the internal register of the source driver that receives the read command. The read command may include the configuration field 2 of FIG. 4** of packet data transmitted to the source driver.

The source driver that receives the read command transmits the parameter value to the timing controller 210 (operation S113). The source driver may transmit the parameter value through the share back channel SBC. The source driver may simultaneously receive a data packet through the data transmission channel DTC and transmit the parameter value through the share back channel SBC, but is not limited thereto. The source driver may transmit the parameter value when not receiving the data packet.

The timing controller 210 stores the received parameter value (operation S114). The timing controller 210 may store the received parameter value in an internally provided storage, for example, memory, a register, etc. In example embodiments, the timing controller 210 may store the parameter value and an address of the source driver corresponding to the parameter value or identification (ID) thereof together.

Operations S112 through S114 may be repeatedly performed so that the respective parameter values OPTM1, OPTM2, . . . , OPTMn of FIG. 2 of the plurality of source drivers **220-1~220-*n* may be stored in the timing controller 210. Operations S112 through S114 may be performed in a display period. In other words, operations S112 through S114 may be performed while the display driving circuit 200 operates in the display data mode S30 of FIG. 3**.

Thereafter, when an abnormal state, i.e., a receive abnormal state, occurs in at least one of the plurality of source drivers **220-1~220-*n*, the at least one of the plurality of source drivers 220-1~220-*n* performs second initialization to recover a system clock (operation S115). The source driver in which the abnormality state occurs may transmit the state information signal SINFO indicating the abnormal state through the share back channel SBC. The timing controller 210 may transmit a training clock to the plurality of source drivers 220-1~220-*n* based on the state information signal SINFO. Each of the plurality of source drivers 220-1~220-*n* may recover the system clock based on a training pattern provided from the timing controller 210**.

If the system clock is recovered, the timing controller 210 transmits the corresponding parameter value to each of the plurality of source drivers **220-1~220-*n* (operation S116). The timing controller 210 may identify the parameter value that is to be provided to each of the plurality of source drivers 220-1~220-*n*** based on the address of the source driver and the ID that are stored along with the parameter value.

Each of the plurality of source drivers 220-1~**220-*n* optimizes the receiving operation based on the transmitted parameter value (operation S117). In this regard, unlike operation S111, training for optimization may not be performed, but the received parameter value only may be applied to the receiving unit, thereby reducing an optimization time. After the receiving operations of the plurality of source drivers 220-1~220-*n* are optimized, the timing controller 210 may operate in the display data mode S30** again.

Figure 6:
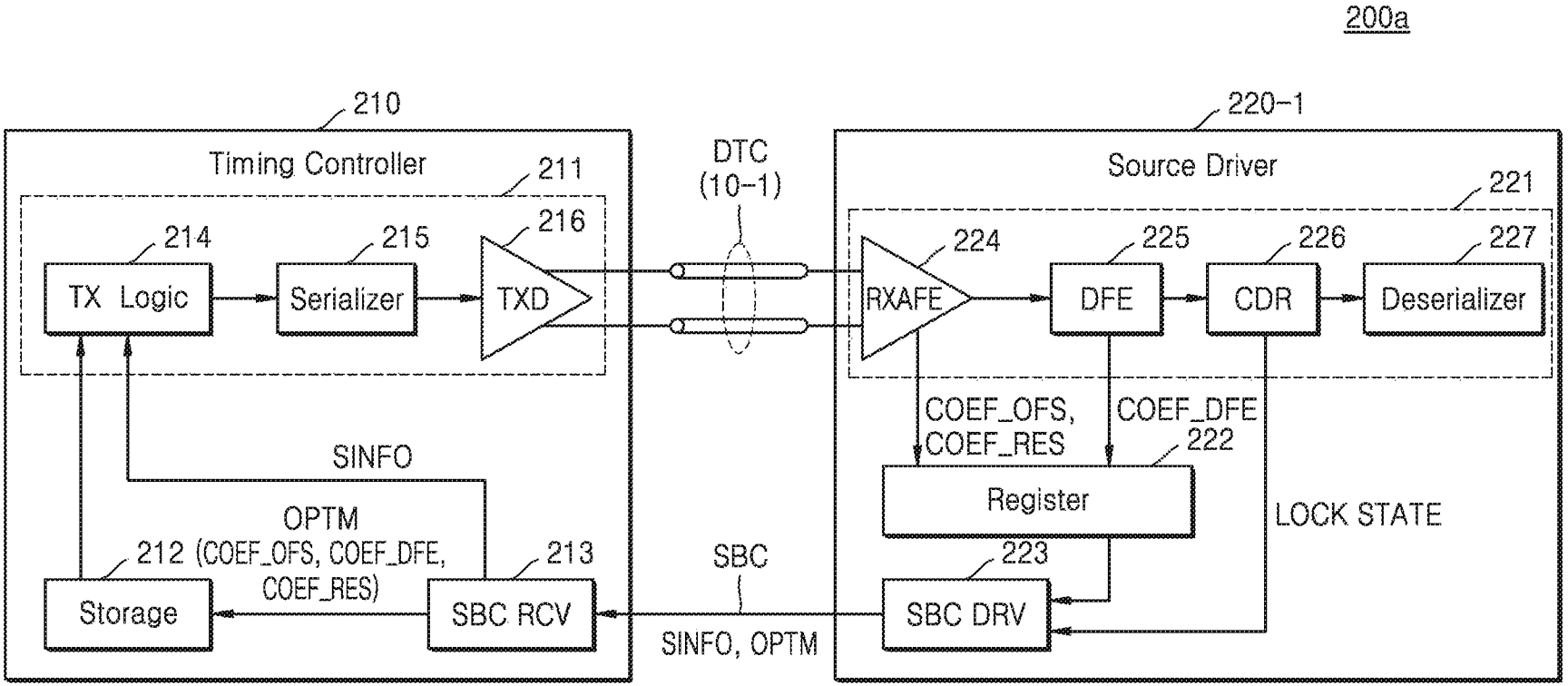
FIG. 6 is a block diagram of a display driving circuit according to example embodiments.

FIG. 6 is a block diagram of a display driving circuit **200*a* according to example embodiments. The timing controller 210 and the first source driver 220-1 of FIG. 2 are illustrated in more detail in the display driving circuit 200*a* of FIG. 6. Thus, the description provided with reference to FIG. 2 may be applied to the display driving circuit 200*a* of FIG. 6. As shown in FIG. 2, the display driving circuit 200*a* may include a plurality of source drivers having the same structure and function as those of the first source driver 220-1. For convenience of description, only the first source driver 220-1 is illustrated in FIG. 6**.

Referring to FIG. 6, the timing controller 210 includes a transmitting unit 211, a storage 212, and a share channel receiver 213 (SBC RCV). The transmitting unit 211 includes a transmission logic 214 (TX Logic), a serializer 215, and a transmission driver 216 (TXD).

The transmission logic 214 may generate transmission data that is to be transmitted to the source driver 220-1 through the data transmission channel DTC. The transmission logic 214 may generate the transmission data of a packet form including display data, various control signals, and an error detection signal. The transmission logic 214 may generate the transmission data based on the state information signal SINFO indicating a receive state of the source driver 220-1. When the state information signal SINFO indicates a receive abnormal state of the source driver 220-1, the transmission logic 214 may control the transmission driver 216 to transmit a training pattern for optimizing a receiving unit 221 of the source driver 220-1. Thereafter, if the state information signal SINFO indicates a receive normal state, the transmission logic 214 may access the storage 212 to read the parameter value OPTM that is to be transmitted to the source driver 220-1 and generate the transmission data of the packet form including the parameter value OPTM.

The serializer 215 may convert the transmission data transmitted in parallel from the transmission logic 215 into serial data. The transmission driver 216 may transmit the serial data through the data transmission channel DTC. As shown in FIG. 6, the data transmission channel DTC may include two signal lines. The transmission driver 216 may convert the serial data into a differential signal pair and may transmit the differential signal pair through the data transmission channel DTC.

The storage 212 may store the parameter value OPTM received from the source driver 220-1. The storage 212 may store the parameter value OPTM received from a plurality of source drivers and may store the parameter value OPTM and an ID of a source driver corresponding to the parameter value OPTM or an address thereof.

The share channel receiver 213 may receive the state information signal SINFO indicating the receive state of the source driver 220-1 and the parameter value OPTM through the share back channel SBC. The share channel receiver 213 may identify the state information signal SINFO and the parameter value OPTM based on a pattern of a signal received from the share back channel SBC or a level thereof. The share channel receiver 213 provides the received parameter value OPTM in the storage 212 and transmits the state information signal SINFO to the transmission logic 214.

The source driver 220-1 includes the receiving unit 221, a register 222, and a share channel driver 223 (SBC DRV).

The receiving unit 221 includes a receive analog front end (RXAFE) 224, an equalizer 225, a clock and data recovery (CDR) circuit 226, and a deserialzier 227. In example embodiments, the equalizer 225 and the CDR circuit 226 may be implemented as one circuit.

The RXAFE 224 may receive the differential signal pair from the data transmission channel DTC. In example embodiments, the RXAFE 224 may include a comparator comparing two signals of the differential signal pair and outputting a single signal. The equalizer 225 may adjust a gain of an input signal to compensate for a distortion of the signal due to the data transmission channel DTC. In the example embodiments, a decision feedback equalizer (DFE) may be applied as the equalizer 225 but is not limited thereto. Various types of equalizers may be applied. An example in which the equalizer 225 is the DFE will now be described below.

The CDR circuit 226 may generate a system clock by using the equalized signal and may recover data. The deserialzier 227 may convert the serial data into parallel data based on the system clock.

The register 222 may store the parameter value OPTM optimizing a receiving operation of the receiving unit 221. For example, the parameter value OPTM may include a resistance level COEF_RES of a variable resistor for impedance matching of the RXAFE 224, a voltage level COEF_OFS of an offset compensation voltage for compensating for an offset of the comparator included in the RXAFE 224, an equalization coefficient COEF_DFE of the DFE 225, etc. In example embodiments, the parameter value OPTM may be a code signal indicating the resistance level COEF_RES, the voltage level COEF_OFS of the offset compensation voltage, and the equalization coefficient COEF_DFE. Besides, the parameter value OPTM may include various types of setting values used to adjust states of elements included in the receiving unit 221.

The share channel driver 223 may transmit a receive state of the receiving unit 221 and the parameter value OPTM through the share back channel SBC. If a read command is received from the timing controller 210, the share channel driver 223 may transmit the parameter value OPTM stored in the register 222 to the timing controller 210 through the share back channel SBC. When a soft fail occurs, such as the parameter value OPTM stored in the register 222 is unexpectedly changed or the CDR circuit 226 is in an unlock state, the share channel driver 223 may transmit the state information signal SINFO of a first level, e.g., logic low, through the share back channel SBC.

Figure 7:
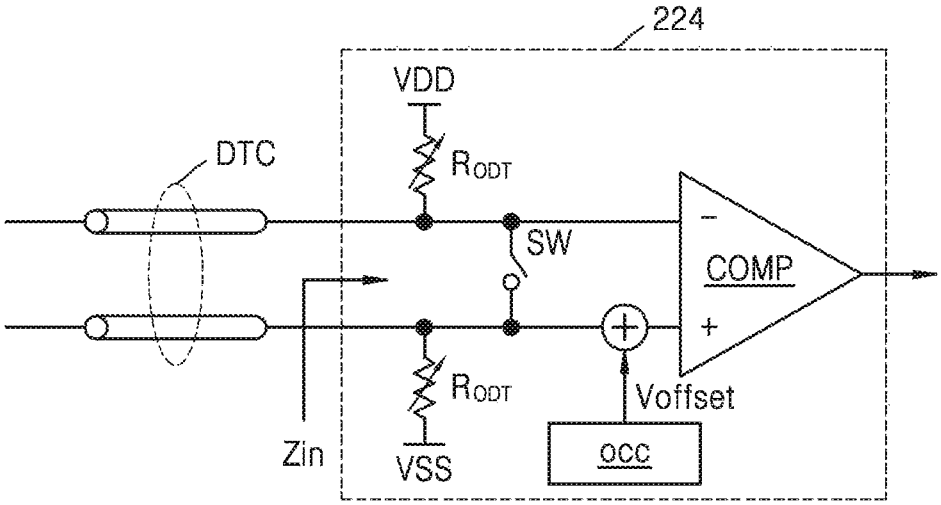
FIG. 7 is a circuit diagram of a receive analog front end (RXAFE) of FIG. 6.

FIG. 7 is a circuit diagram of the RXAFE 224 of FIG. 6.

Referring to FIG. 7, the RXAFE 224 includes a comparator COMP receiving a differential signal pair transmitted through the data transmission channel DTC, a switch SW connecting two inputs of the comparator COMP, an offset compensation circuit OCC, and variable resistors $R_{ODT}$ connected to input ends of the comparator COMP. In example embodiments, the variable resistors $R_{ODT}$ are termination resistors connected to power voltages VDD and VSS.

In a DC training period, resistance values of the variable resistors $R_{ODT}$ may be programmably adjusted, and thus an input impedance Zin may be matched suitably to the data transmission channel DTC.

When the switch SW is turned on in the DC training period and the two inputs of the comparator COMP are connected, the offset compensation circuit OCC may compensate for an offset of the comparator COMP based on an output of the comparator COMP. The offset compensation circuit OCC may provide an offset compensation voltage Voffset to one input terminal of the comparator COMP such that the output of the comparator COMP is a middle level of a sum of power voltages applied to the comparator COMP, thereby compensating for the offset of the comparator COMP.

The resistance level of the variable resistors $R_{ODT}$ for impedance Zin matching, a voltage level of the offset compensation voltage Voffset for compensating for the offset of the comparator COMP, etc. may be parameter values optimizing a receiving operation and may be stored in the register 222 of FIG. 6.

Figure 8:
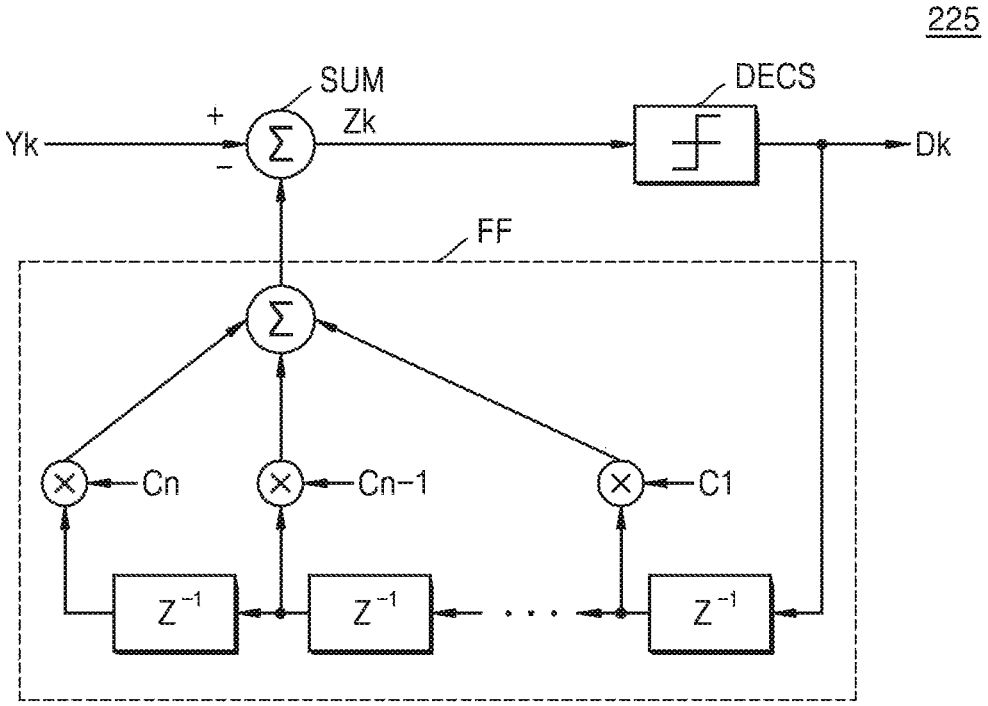
FIG. 8 is a circuit diagram of a decision feedback equalizer (DFE) of FIG. 6.

FIG. 8 is a circuit diagram of the DFE 225 of FIG. 6.

Referring to FIG. 8, the DFE 225 includes a summing unit SUM, a feedback filter FF, and a decider DECS. The DFE 225 provides negative-feedback of a value to a receive signal Yk by applying a weight to a decision value Dk through the feedback filter FF, thereby reducing an error between symbols of the receive signal that occurs due to a signal distortion.

Optimization values of equalization coefficients C1, . . . , Cn−1, Cn of the feedback filter FF may be calculated through AC training, and thus the DFE 225 may be optimized. The calculated optimization value of the equalization coefficients C1, . . . , Cn−1, Cn may be parameter values optimizing a receiving operation and may be stored in the register 222 of FIG. 6.

Figure 9:
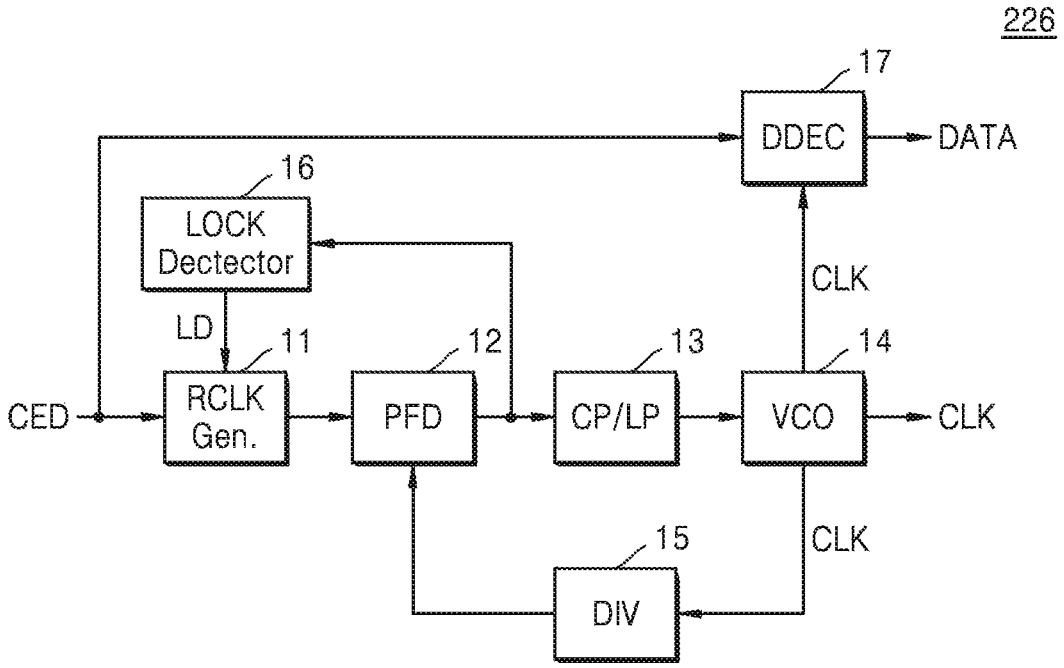
FIG. 9 is a block diagram of a clock and data recovery (CDR) circuit of FIG. 6.

FIG. 9 is a block diagram of the CDR circuit 226 of FIG. 6.

Referring to FIG. 9, the CDR circuit 226 includes a reference clock (RCLK) generator 11, a phase frequency detector (PFD) 12, a charge pump/loop filter (CP/LP) 13, a voltage controlled oscillator (VCO) 14, a divider (DIV) 15, a lock (LOCK) detector 16, and a data determiner (DDEC) 17.

The reference clock generator 11 may output a clock signal included in received clock embedded data CED as a reference clock signal based on a lock detection signal LD having a first level, e.g., logic low. For example, the clock embedded data CED transmitted in an initialization period may be a training pattern. The PFD 12 may compare the reference block signal and a division clock signal and detect and output a phase difference therebetween. The CP/LP 13 may convert an output signal of the PFD 12 into a voltage signal and may output the voltage signal as a control voltage signal for controlling the VCO 14. The VCO 14 outputs a clock signal CLK having a frequency in response to (i.e., based on) the control voltage signal. The clock signal CLK may be a system clock of the source driver 220-1. The divider 15 may divide the clock signal CLK output by the VCO 14 and output the clock signal CLK as a division clock signal. The data determiner 17 recovers data DATA from the clock embedded data CED based on the clock signal CLK.

The lock detector 16 outputs the lock detection signal LD based on the output signal of the PFD 12. When the CDR circuit 226 is in a lock state, the lock detector 16 may output the lock detection signal LD of a second level, e.g., logic high. When the CDR circuit 226 is an unlock state, the lock detector 16 may output the lock detection signal LD of a first level, .e.g., logic low. Through AC training, the CDR circuit 226 may be in the lock state, and the lock detection signal LD may output the lock detection signal LD of the second level, which indicates that the receiving unit 221 of FIG. 6 may be in a data receive state.

As described above, the elements of the receiving unit 221 of FIG. 6 are described with reference to FIGS. 7 through 9. However, these are example embodiments. The elements of the receiving unit 221 are not limited thereto. Structures of the RXAFE 224, the DFE 225, and the CDR circuit 226 may be variously modified.

Figure 10:
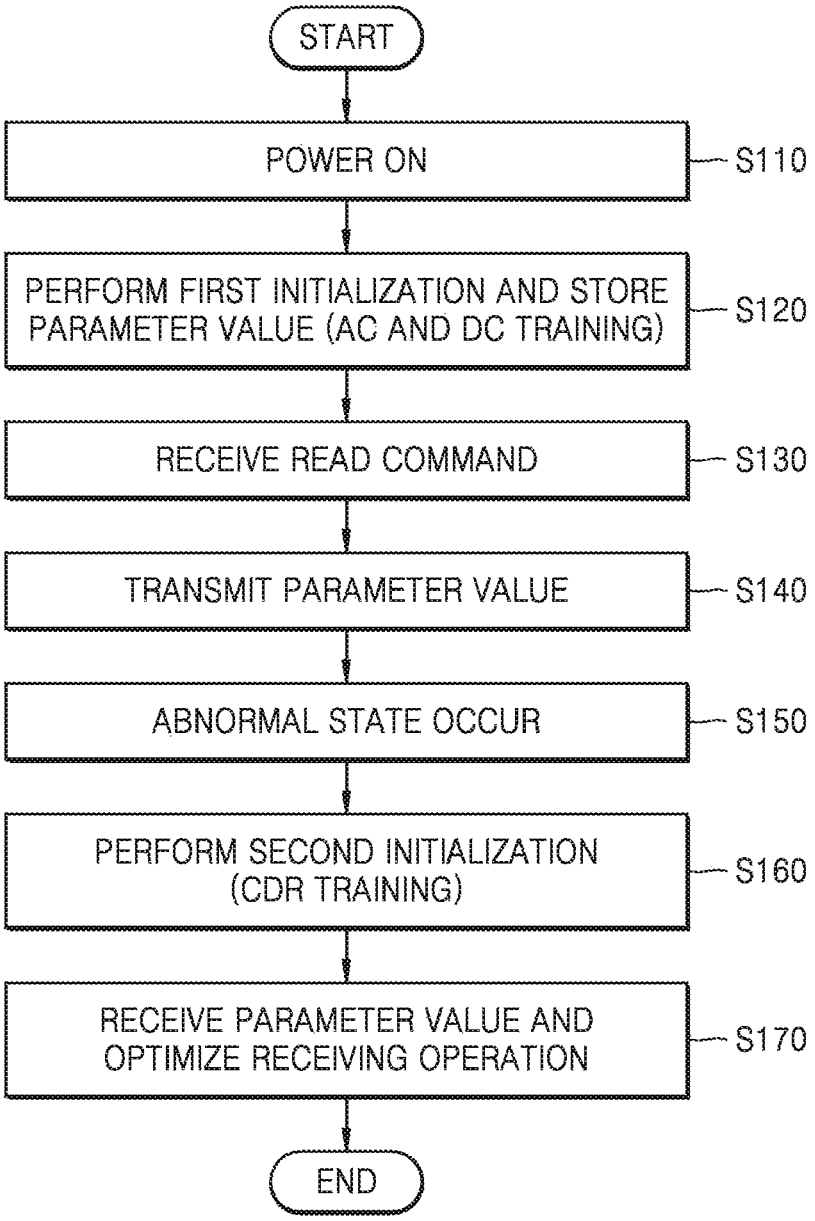
FIG. 10 is a flowchart of a method of operating a source driver according to example embodiments.

FIG. 10 is a flowchart illustrating a method of operating a source driver according to example embodiments. The method of operating the source driver of FIG. 10 is an example of the method of operating a source driver of FIG. 6.

Referring to FIG. 10, if power is supplied to the source driver (operation S110), the source driver performs first initialization (operation S120). The source driver performs DC training and AC training on a receiving unit to determine a parameter value optimizing a receiving operation of the receiving unit, and stores the parameter value in a register. Accordingly, the receiving operation of the receiving unit may be optimized.

After the parameter value is stored, a read command is received from a timing controller (operation S130). The source driver transmits the parameter value to the timing controller in response to (i.e., based on) the read command (operation S140). In a display period, the read command may be received (operation S130) and the parameter value may be transmitted (operation S140). The source driver may simultaneously receive display data and receive the read command or transmit the parameter value.

Thereafter, in the display period, if an abnormal state in which the receiving unit of the source driver does not normally receive data occurs (operation S150), the source driver performs second initialization (operation S160). The source driver recovers a system clock through training of a CDR circuit.

If the system clock is recovered, the source driver receives the parameter value from the timing controller and optimizes the receiving operation of the receiving unit based on the parameter value (operation S170). After the receiving operation is optimized, the source driver may continue to receive the display data.

Figure 11:
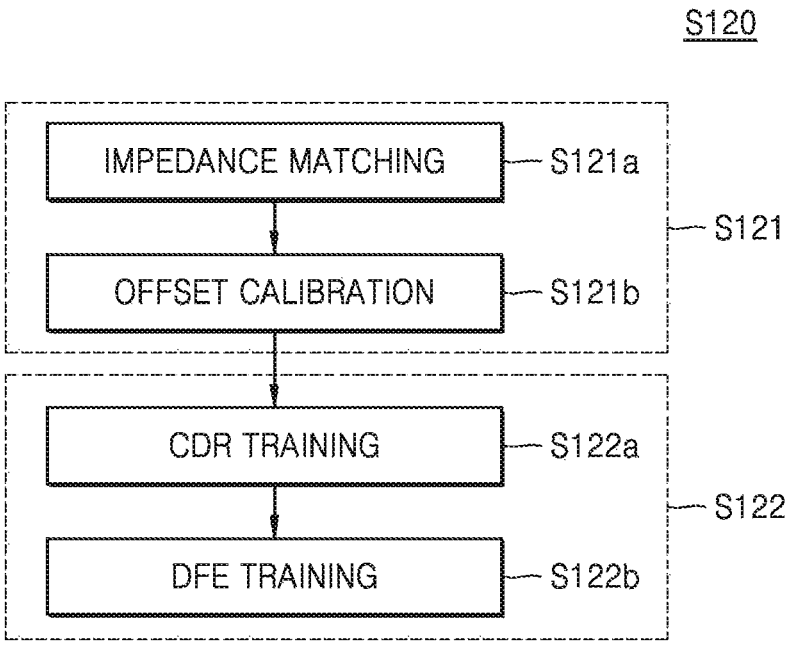
FIG. 11 is a flowchart of a first initialization operation of FIG. 10.

FIG. 11 is a flowchart illustrating first initialization (operation S120) of FIG. 10.

Referring to FIG. 11, during first initialization (operation S120), a source driver performs DC training (operation S121) and AC training (S122) on a receiving unit.

DC training (operation S121) includes impedance matching (operation S121*a*) of the RXAFE 224 of FIG. 6 and offset calibration (operation S121*b*) of the comparator COMP. The resistance level COEF_RES of a resistor according to impedance matching (operation S121*a*) and the voltage level COEF_OFS of an offset compensation voltage according to offset calibration (operation S121*b*) may be stored in the register 222 of FIG. 6. Offset calibration (operation S121*b*) is performed after impedance matching (operation S121*a*) is performed in FIG. 11, but this is not limited thereto. Impedance matching (operation S121*a*) may be performed after offset calibration (operation S121*b*) is performed. In example embodiments, one among impedance matching (operation S121*a*) and offset calibration (operation S121*b*) may be performed.

Thereafter, AC training (operation S122) is performed. AC training (operation S122) includes CDR training (operation S122*a*) to place the CDR circuit 226 of FIG. 6 in a lock state and DFE training (operation S122*b*) to optimize the equalization coefficient COEF_DFE of the DFE 225 of FIG.

6. If the CDR circuit 226 is in the lock state according to the CDR training (operation S122*a*), the CDR circuit 226 may output the lock detection signal LD of a second level, e.g., logic high. Through DFE training (operation S122*b*), the equalization coefficient COEF_DFE of the DFE 225 may be determined and stored in the register 222.

DFE training (operation S122*b*) is performed after CDR training (operation S122*a*) is performed in FIG. 11, but this is not limited thereto. An order may be changed. In example embodiments, DFE training (operation S122*b*) may be first performed. In example embodiments, CDR training (operation S122*a*) and DFE training (operation S122*b*) may be simultaneously performed. In example embodiments, DFE training (operation S122*b*) may be skipped, and only CDR training (operation S122*a*) may be performed.

Figure 12:
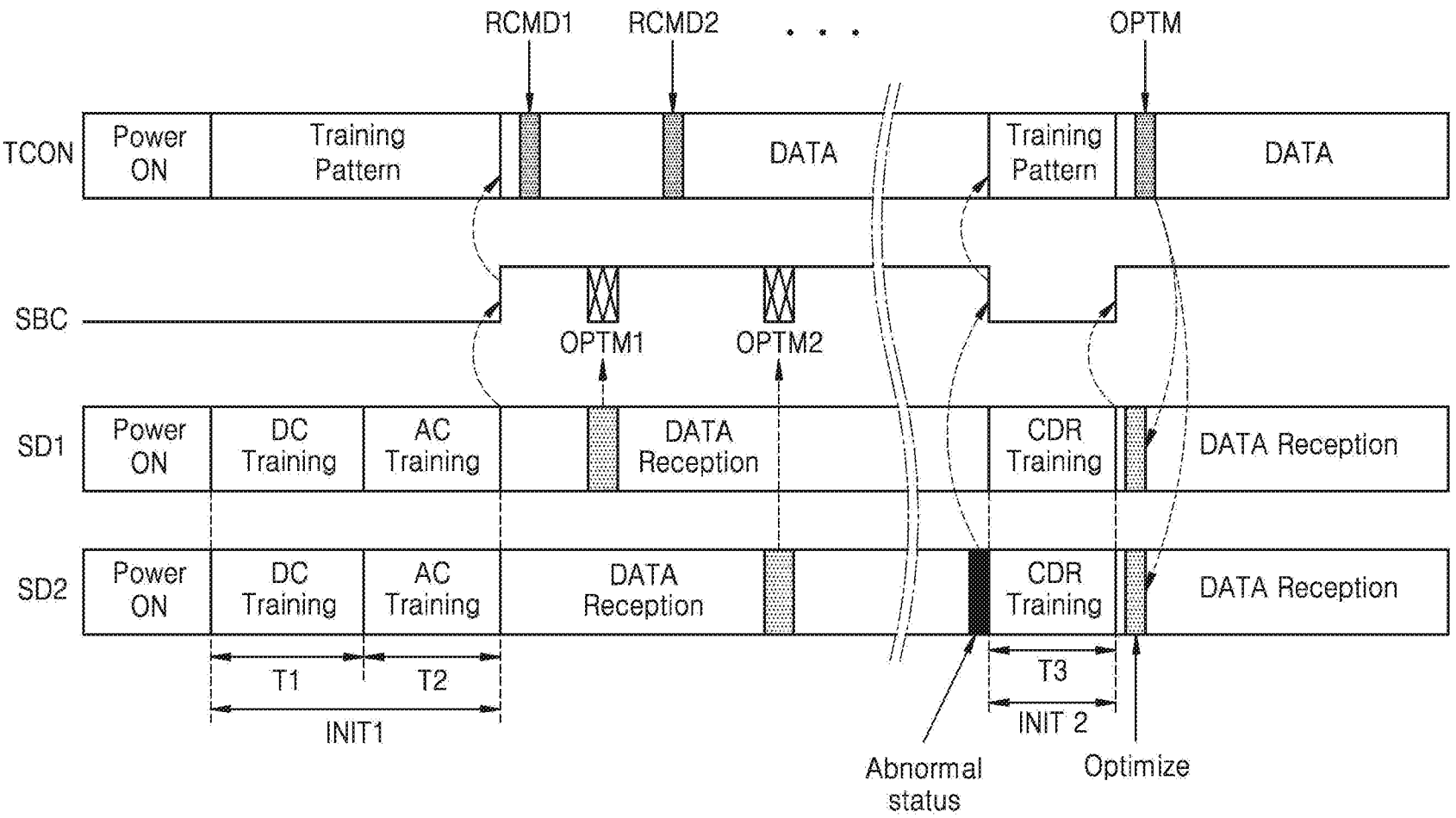
FIG. 12 is a timing diagram of a method of operating a display driving circuit according to example embodiments.

FIG. 12 is a timing diagram of a method of operating a display driving circuit according to example embodiments. FIG. 12 is a timing diagram of the display driving circuit 200 of FIG. 2. For convenience of description, a timing controller TCON and two source drivers SD1 and SD2 are illustrated.

Referring to FIG. 12, if power is supplied to the display driving circuit 200, the first source driver SD1 and the second source driver SD2 perform first initialization INIT1. First initialization INIT1 are performed in a first period T1 and a second period T2. In this regard, the first source driver SD1 and the second source driver SD2 may be in a state in which packet data is not received. The first source driver SD1 and the second source driver SD2 may transmit a state information signal of a first level, e.g., logic low, to the timing controller TCON through the share back channel SBC. The timing controller TCON may detect the share back channel SBC, thereby determining states of the first source driver SD1 and the second source driver SD2. If the state information signal of the first level is received through the share back channel SBC, the timing controller TCON transmits a training pattern to each of the first source driver SD1 and the second source driver SD2. The timing controller TCON may transmit the training pattern to each of the first source driver SD1 and the second source driver SD2 through a plurality of data transmission channels. The plurality of data transmission channels may include a first channel connected to the first source driver SD1 and a second channel connected to the second source channel SD2. The first source driver SD1 and the second source driver SD2 may perform first initialization INIT1 based on the received training patterns.

The first source driver SD1 and the second source driver SD2 perform DC training in the first period T1 and AC training in the second period T2. A length of the second period T2 may be shorter than a length of the first period T1. The first source driver SD1 and the second source driver SD2 may determine parameter values of a receiving unit optimizing a receiving operation of the receiving unit and store the parameter values in the register.

If first initialization INIT1 is complete, the first source driver SD1 and the second source driver SD2 are in a data receiving state. If both the first source driver SD1 and the second source driver SD2 completely perform first initialization INIT1, the first source driver SD1 and the second source driver SD2 may transmit a state information signal of a second level, e.g., logic high, to the timing controller TCON through the share back channel SBC. The timing controller TCON may transmit data in response to (i.e., based on) a change in the state information signal. The timing controller TCON may transmit packet data including display data.

For example, in a data transmission period, the timing controller TCON may sequentially transmit a plurality of read command RCMD1 and RCMD2. For example, the timing controller TCON may transmit the first read command RCMD1 to the first source driver SD1 through the first channel and then the second read command RCMD2 to the second source driver SD2 through the second channel. The first read command RCMD1 may be included in a configuration field of packet data transmitted to the first source driver SD1. The second read command RCMD2 may be included in a configuration field of packet data transmitted to the second source driver SD2. The read commands RCMD1 and RCMD2 may be included in a frame configuration field or a line configuration field of the packet data.

The first source driver SD1 may transmit the first parameter value OPTM1 to the timing controller TCON in response to (i.e., based on) the first read command RCMD1. The second source driver SD2 may transmit the second parameter value OPTM2 to the timing controller TCON in response to (i.e., based on) the second read command RCMD2. The first source driver SD1 and the second source driver SD2 may convert the first and second parameter values OPTM1 and OPTM2 into data in packet form and may transmit the converted parameter values OPTM1 and OPTM2 to the timing controller TCON through the share back channel SBC. The share back channel SBC may be shared by the first source driver SD1 and the second source driver SD2 may, and thus the first and second parameter values OPTM1 and OPTM2 may be sequentially transmitted.

In example embodiments, the first source driver SD1 may transmit the first parameter value OPTM1 in a first frame display period in response to (i.e., based on) the first read command RCMD1, and the second source driver SD2 may transmit the second parameter value OPTM2 in a second frame display period in response to (i.e., based on) the second read command RCMD2. As described above, a parameter value with respect to one source driver may be transmitted in one frame display period. In this regard, the first read command RCMD1 and the second read command RCMD2 may be transmitted by being included in the frame configuration field of the packet data transmitted to each of the first source driver SD1 and the second source driver SD2.

In example embodiments, the first source driver SD1 may transmit the first parameter value OPTM1 in a partial period of the first frame display period in response to (i.e., based on) the first read command RCMD1, and the second source driver SD2 may transmit the second parameter value OPTM2 in another partial period of the first frame display period in response to (i.e., based on) the second read command RCMD2. As described above, a plurality of parameter values with respect to a plurality of source drivers may be transmitted in one frame display period. In this regard, the first read command RCMD1 and the second read command RCMD2 may be transmitted by being included in the frame configuration field or the line configuration field of the packet data transmitted to each of the first source driver SD1 and the second source driver SD2.

The timing controller TCON may store the received parameter values OPTM1 and OPTM2. In a period other than the periods in which the first and second parameter values OPTM1 and OPTM2 are transmitted, the share back channel SBC may transmit the state information signal of the second level.

Continuously, while the first source driver SD1 and the second source driver SD2 are receiving the data, a receive abnormal state or status may occur in at least one source driver. For example, as shown in FIG. 12, if the receive abnormal state occurs in the second source driver SD2, the second source driver SD2 may transmit the state information signal of the first level to the timing controller TCON through the share back channel SBC. The timing controller TCON transmits the training pattern to each of the first source driver SD1 and the second source driver SD2 in response to (i.e., based on) the state information signal of the first level. The first source driver SD1 and the second source driver SD2 perform CDR training to recover a system clock. Second initialization INIT2 is performed in a third period T3. A length of the third period T3 may be shorter than lengths of the first period T1 and the second period T2.

If second initialization INIT2 is complete, and thus system clocks of the first source driver SD1 and the second source driver SD2 are recovered, the first source driver SD1 and the second source driver SD2 may transmit the state information signal of the second level, e.g., logic high, to the timing controller TCON through the share back channel SBC. The timing controller TCON may transmit data in response to (i.e., based on) a change in the state information signal.

The timing controller TCON may transmit packet data including the display data or configuration data. In this regard, the timing controller TCON may transmit packet data including the stored parameter value OPTM. The timing controller TCON may transmit the parameter values OPTM1 and OPTM2 corresponding to the first source driver SD1 and the second source driver SD2 to the first source driver SD1 and the second source driver SD2, respectively. In this regard, although the first source driver SD1 and the second source driver SD2 are in a data receiving state, when data is transmitted at a high speed higher than a threshold level because the receiving operation is not optimized, a receive error may occur. Thus, the timing controller TCON may transmit the parameter values OPTM1 and OPTM2 at a speed lower than the threshold level.

The first parameter value OPTM1 may be included in the configuration field of the packet data transmitted to the first source driver SD1. The second parameter value OPTM2 may be included in the configuration field of the packet data transmitted to the second source driver SD2. The first source driver SD1 and the second source driver SD2 may apply the received parameter values OPTM1 and OPTM2 to the receiving unit, thereby optimizing the receiving operation of the receiving unit.

Thereafter, the timing controller TCON may transmit the packet data including the display data to the first source driver SD1 and the second source driver SD2. The receiving operations of the first source driver SD1 and the second source driver SD2 may be optimized, thereby transmitting the packet data at the high speed higher than the threshold level.

Figure 13A:
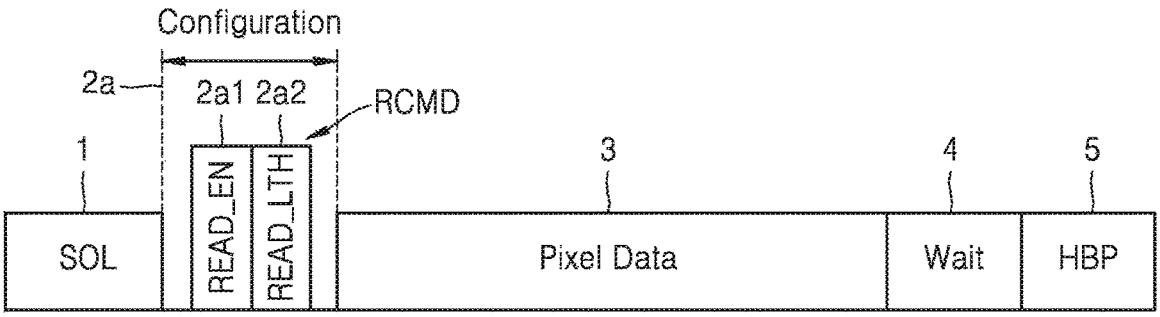
FIGS. 13A, 13B, and 13C are diagrams of data transmitted and received in a display driving circuit, according to example embodiments.
Figure 13B:
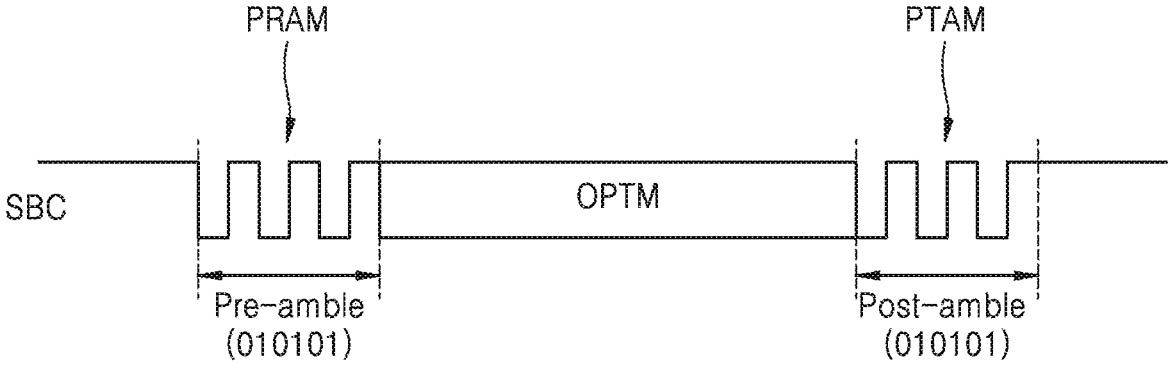
Figure 13C:
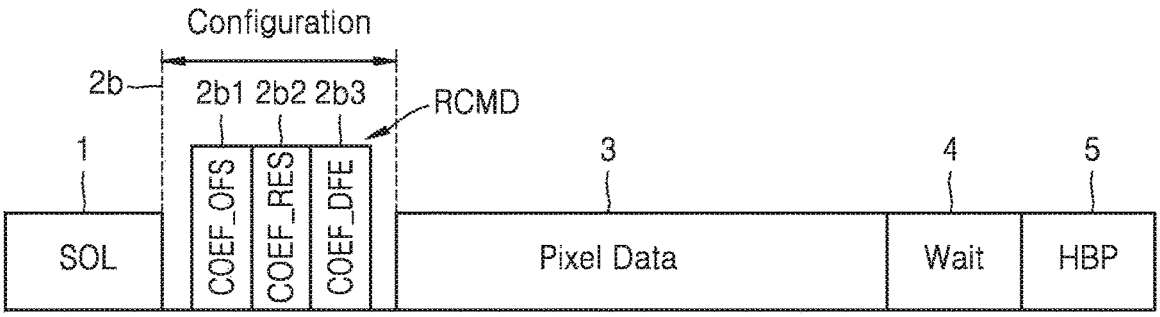

FIGS. 13A, 13B, and 13C are diagrams of data transmitted and received in a display driving circuit, according to example embodiments. FIG. 13A illustrates packet data including a read command (RCMD). FIG. 13B illustrates the parameter value OPTM transmitted through the share back channel SBC. FIG. 13C illustrates packet data including the parameter value OPTM.

Referring to FIG. 13A, the read command transmitted from a timing controller to a source driver is included in a configuration field 2*a* of the packet data. The read command includes a read enable signal 2*a*1 (READ_EN), length information 2*a*2 (READ_LTH), etc. The length information 2*a*2 may indicate a data length, e.g., a bit number, of the parameter value OPTM that is to be transmitted to the timing controller.

The source driver that received the packet data shown in FIG. 13A may transmit the parameter value OPTM to the timing controller based on the read enable signal 2*a*1. The source driver may convert the parameter value OPTM into packet data having a data length corresponding to the length information 2*a*2 and may transmit the packet data to the timing controller.

Referring to FIG. 13B, a preamble signal PRAM, the parameter value OPTM, and the post amble signal PTAM are sequentially transmitted through the share back channel SBC. The share back channel SBC may be used to transmit a state information signal of the source driver and the parameter value OPTM. When the share back channel SBC is used to transmit a signal of a first level or a second level, this may mean the state information signal of the source driver. The source driver may transmit the preamble signal PRAM and a post-amble signal PTAM to notify that the parameter value OPTM is transmitted through the share back channel SBC. The preamble signal PRAM may include a code signal and may indicate a start of transmission of the parameter value OPTM. The post-amble signal PTAM may also include a code signal and may indicate an end of transmission of the parameter value OPTM. The parameter value OPTM may be transmitted in packet data. The preamble signal PRAM and the post-amble signal PTAM have the same code signal in FIG. 13B but are not limited thereto. The preamble signal PRAM and the post-amble signal PTAM may have different code signals.

Referring to FIG. 13C, the parameter value OPTM transmitted from the timing controller to the source driver is included in a configuration field 2*b* of the packet data. The parameter value OPTM includes COEF_RES 2*b*1, COEF_OFS 2*b*2 and COEF_DFE 2*b*3, etc. COEF_RES is a resistance level of a variable resistor for impedance matching of the RXAFE, COEF_OFS is a voltage level of an offset compensation voltage for compensating for an offset of the comparator included in the RXAFE, and COEF_DFE is an equalization coefficient of the DFE. The parameter value OPTM is included in the configuration field 2*b*, e.g., a line configuration field, of the packet data including a pixel data field 3 in FIG. 13C, but is not limited thereto. The packet data may not include pixel data and may include a frame configuration field. The frame configuration field may include frame control data controlling frame setting of an image frame. The parameter value OPTM may be included in the frame configuration field.

Figure 14A:
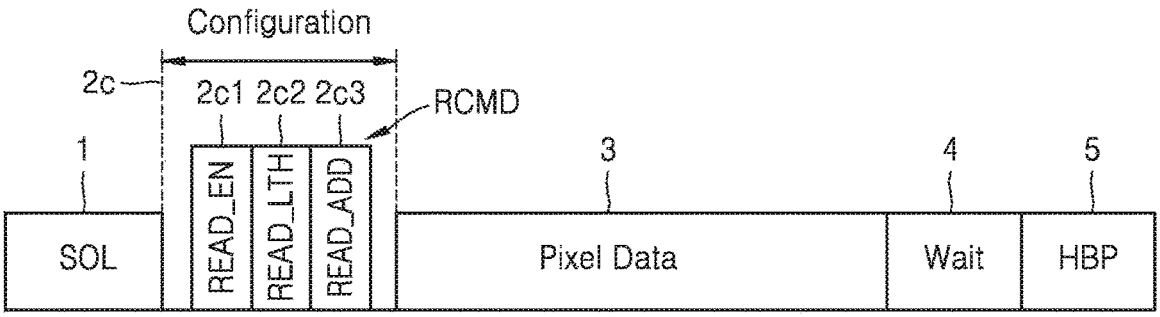
FIGS. 14A and 14B are diagrams of data transmitted and received in a display driving circuit according to example embodiments.
Figure 14B:
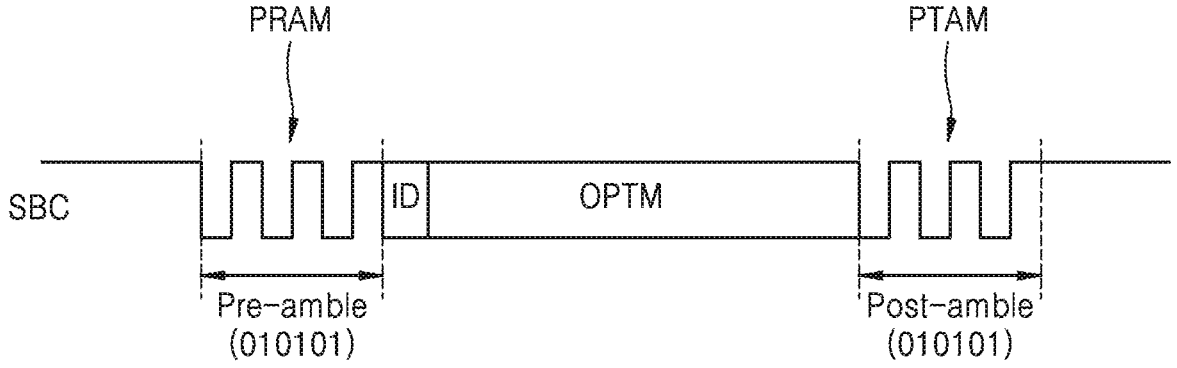

FIGS. 14A and 14B are diagrams of data transmitted and received in a display driving circuit, according to example embodiments. FIG. 14A illustrates packet data including a read command RCMD. FIG. 14B illustrates the parameter value OPTM.

Referring to FIG. 14A, the read command is included in a configuration field 2*c* of the packet data. The read command includes a read enable signal 2*c*1 (READ_EN), length information 2*c*2 (READ_LTH), and address information 2*c*3 (READ_ADD), etc. The address information 2*c*3 may indicate an address of a source driver receiving the read command or an ID allocated to the source driver. The source driver receiving the packet data may transmit the parameter value OPTM to a timing controller based on the read enable signal 2*c*1. As shown in FIG. 14B, the source driver may convert the parameter value OPTM and the ID into packet data having a data length corresponding to the length information 2*c*2 and may transmit the packet data to the timing controller. The source driver sequentially transmits the preamble signal PRAM, the packet data including the parameter value OPTM and the ID, and the post-amble signal PTAM through the share back channel SBC.

Figure 15:
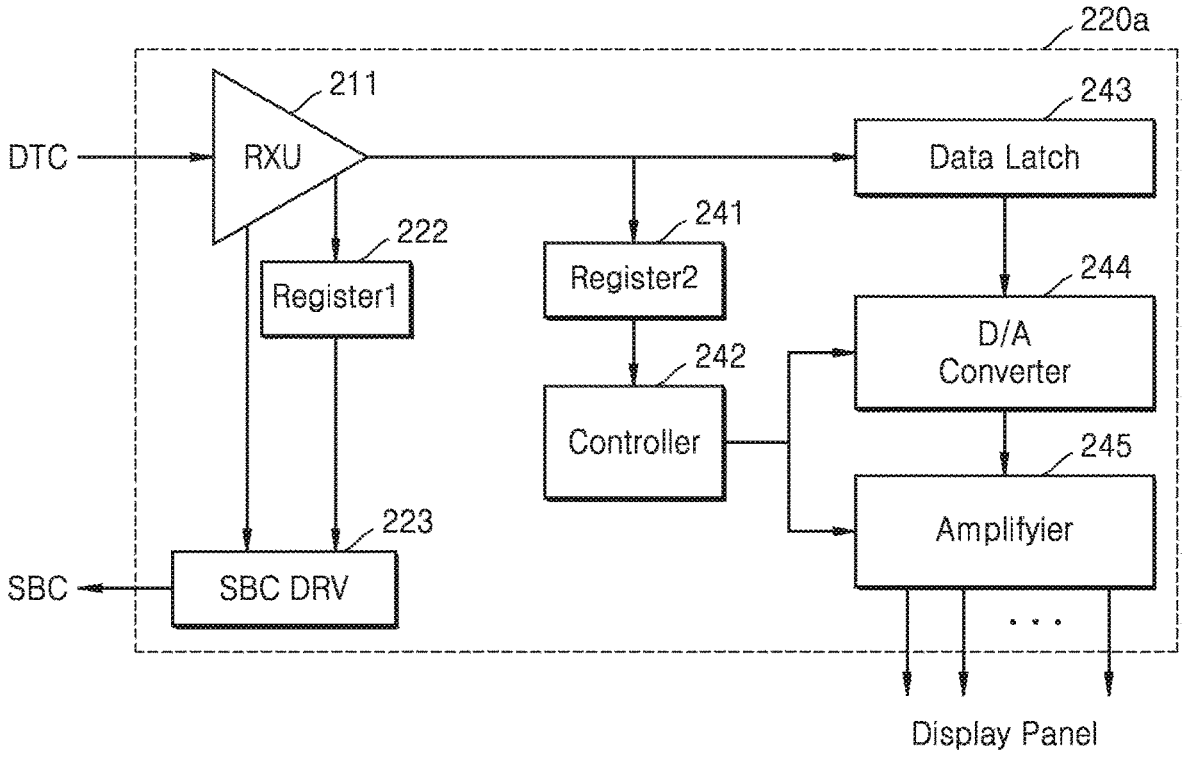
FIG. 15 is a block diagram of a source driver according to example embodiments.

FIG. 15 is a block diagram of a source driver 220*a* according to example embodiments. The source driver 220*a* according to the example embodiments may be applied to the plurality of source drivers 220-1~220-*n* of FIG. 2.

Referring to FIG. 15, the source driver 220*a* includes the receiving unit 221, the first register 222 (Register1), the share channel driver 223, a second register 241 (Register2), a controller 242, a data latch 243, a digital-analog converter 244, and an amplifier 245.

The receiving unit 221 may receive data from the timing controller 210 of FIG. 2 through the data transmission channel DTC. In this regard, the receiving unit 221 may receive serial data and convert the received serial data into parallel data. Image data included in the received data may be provided to the data latch 243, and configuration data included therein for controlling the source driver may be provided to the second register 241. A parameter value of the receiving unit 221 included in the received data may be provided to the first register 222.

In a first initialization period, the receiving unit 221 may determine a parameter value optimizing a receiving operation through training. The parameter value may be provided to the first register 222. In example embodiments, the first register 222 and the second register 241 may be implemented as one circuit.

The share channel driver 223 may output a receive state of the receiving unit 221 and the parameter value stored in the first register through the share back channel SBC.

The data latch 243 may store the image data. In example embodiments, the data latch 243 may include a shift register. The shift register may shift and store the provided image data. If the image data corresponding to pixels of one row of the display panel 230 of FIG. 4 is stored in the data latch 243, the data latch 243 may provide the stored image data to the digital-analog converter 244. The digital-analog converter 244 may select a gradation voltage based on the image data to generate an analog signal and may provide the analog signal to the amplifier 245. The amplifier 245 may amplify the analog signal and provide an amplified analog signal to a data line of the display panel 230.

The controller 242 may control the overall operation of the source driver 220*a*. The controller 242 may control operations of other elements of the source driver 220*a*, for example, the data latch 243, the digital-analog converter 244, the amplifier 246, and the receiving unit 221, based on the configuration data stored in the second register 241. In example embodiments, the controller 242 may control an initialization operation of the receiving unit 221 based on an initialization control signal stored in the second register 241. For example, the initialization control signal may be a signal used to control the receiving unit 221 selectively to perform a first initialization operation or a second initialization operation.

Figure 16:
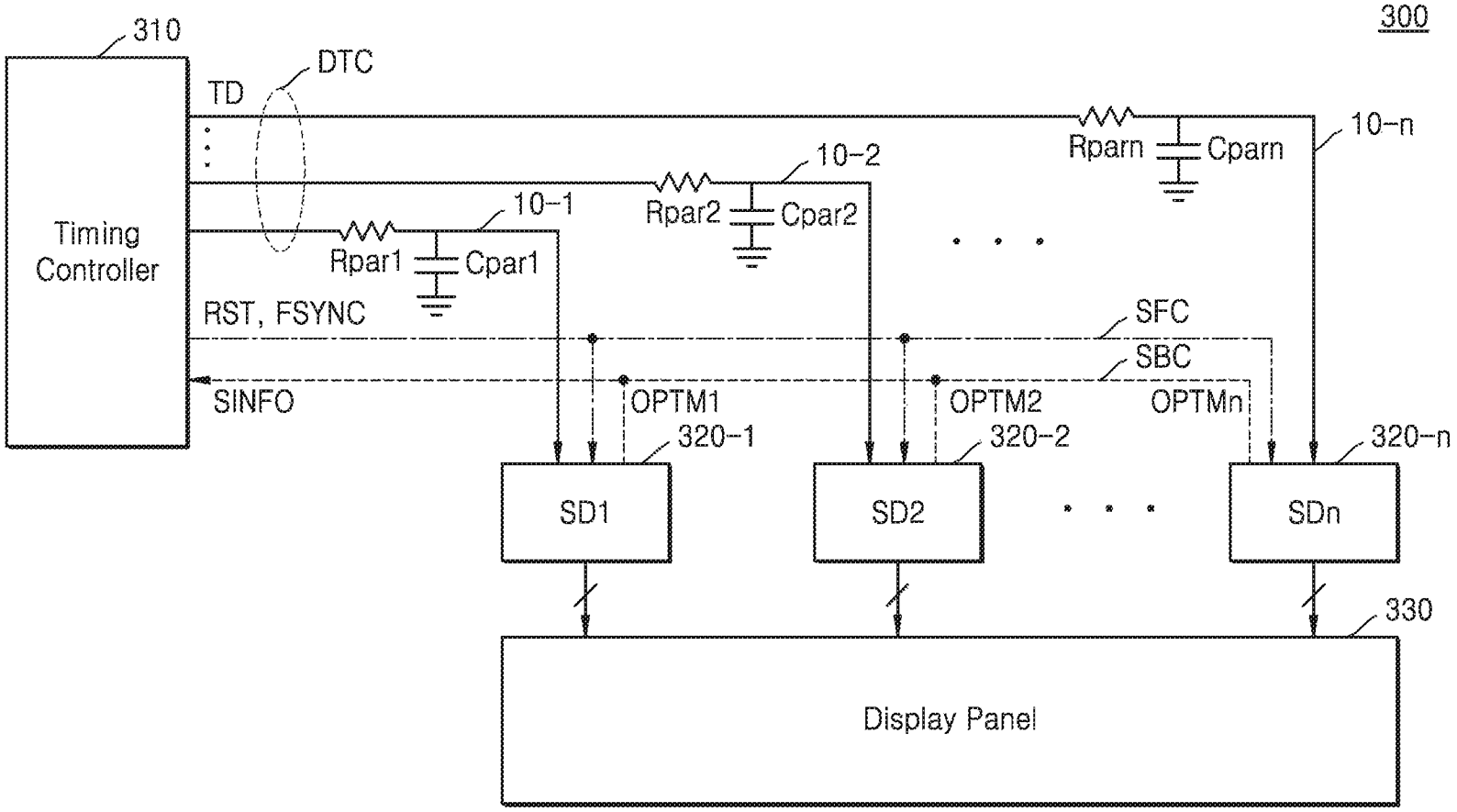
FIG. 16 is a block diagram of a display driving circuit according to example embodiments.

FIG. 16 is a block diagram of the display driving circuit 300 according to example embodiments.

FIG. 16 illustrates the display driving circuit 300 to which the transmitting and receiving system 100 of FIG. 1 is applied. A method of operating the transmitting and receiving system 100 described with reference to FIG. 1 above may be applied to the display driving circuit 300 of the example embodiments. A display panel 330 is also illustrated in the display driving circuit 300 of FIG. 16.

Referring to FIG. 16, the display driving circuit 300 includes a timing controller 310, a plurality of source drivers 320-1~320-*n*, the data transmission channel DTC, the share back channel SBC, and a share forward channel SFC.

A configuration and an operation of the display driving circuit 300 of FIG. 16 are similar to a configuration and an operation of the display driving circuit 200 of FIG. 2. Compared to the display driving circuit 200 of FIG. 2, the display driving circuit 300 further includes the share forward channel SFC. The timing controller 310 may be connected to the plurality of source drivers 320-1~320-*n* in a multi-drop manner through the share forward channel SFC.

The timing controller 310 transmits a reset signal RST to the plurality of source drivers 320-1~320-*n* through the share forward channel SFC. The plurality of source drivers 320-1~320-*n* may train an internally provided CDR circuit in response to (i.e., based on) the reset signal RST transmitted through the share forward channel SFC. In other words, the plurality of source drivers 320-1~320-*n* may perform second initialization to recover system clocks.

In example embodiments, the timing controller 310 may transmit a synchronization signal to the plurality of source drivers 320-1~320-*n* through the share forward channel SFC. For example, the synchronization signal may be a frame synchronization signal FSYNC. The plurality of source drivers 320-1~320-*n* may operate in a vertical blank mode in response to (i.e., based on) the frame synchronization signal FSYNC transmitted through the share forward channel SFC. In example embodiments, the plurality of source drivers 320-1~320-*n* may perform second initialization when operating in the vertical blank mode.

Functions of the timing controller 310, the plurality of source drivers 320-1~320-*n*, the data transmission channel DTC, and the share back channel SBC are similar to functions of the timing controller 210, the plurality of source drivers 220-1~220-*n*, the data transmission channel DTC, and the share back channel SBC of the display driving circuit 200 of FIG. 2, and thus redundant descriptions thereof are omitted.

When first initialization is performed in the display driving circuit 300 according to the example embodiments, the plurality of source drivers 320-1~320-*n* may determine the parameter values OPTM1~OPTMn optimizing an receiving operation of a receiving unit through training and may sequentially transmit the parameter values OPTM1~OPTMn through the share back channel SBC in response to (i.e., based on) a read command received from the timing controller 310 in a display period. The timing controller 310 may store the transmitted parameter values OPTM1~OPTMn, and then, when a receive abnormal state occurs in at least one among the plurality of source drivers 320-1~320-*n*, the timing controller 310 may transmit the parameter values OPTM1~OPTMn to the plurality of source drivers 320-1~320-*n*.

If the receive abnormal state occurs in the at least one source driver, the plurality of source drivers 320-1~320-*n* may perform second initialization to recover system blocks and then apply the parameter values OPTM1~OPTMn transmitted from the timing controller 310 to the receiving unit, thereby quickly optimizing the receiving unit without training.

The plurality of source drivers 320-1~320-*n* may perform second initialization in response to (i.e., based on) the reset signal RST or the frame synchronization signal FSYNC transmitted from the timing controller 31 through the share forward channel SFC. However, in this case, the parameter values OPTM1~OPTMn of the plurality of source drivers **320-1~320-*n*** are not changed, and thus the receiving unit may not be optimized.

Figure 17:
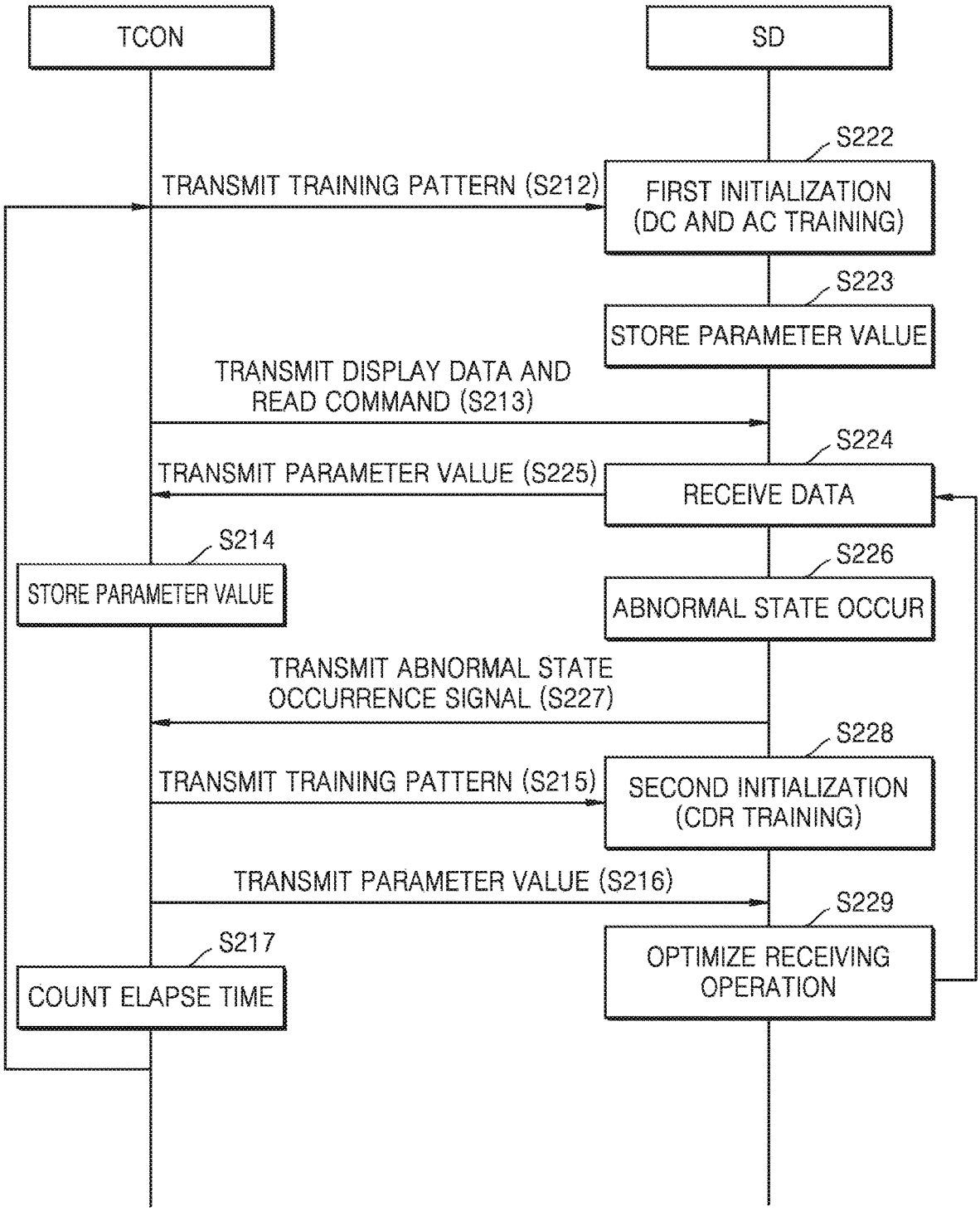
FIG. 17 is a flowchart of a method of operating a display driving circuit, according to example embodiments.

FIG. 17 is a flowchart illustrating a method of operating a display driving circuit, according to example embodiments. The method of operating the display driving circuit of FIG. 17 may be applied to the display driving circuits of FIGS. 2 and 16.

Referring to FIG. 17, the source driver SD performs first initialization (operation S222). The source driver SD may perform DC training and AC training on a receiving unit. In this regard, the timing controller TCON transmits a training pattern to the source driver SD through the data transmission channel DTC (operation S212). The source driver SD may perform initialization based on the training pattern. In example embodiments, DC training may be performed irrespective of the training pattern, and AC training may be performed based on the received training pattern.

The source driver SD stores a parameter value of a receiving unit determined according to first initialization (operation S223). The source driver SD may store the parameter value in an internally provided register Thereafter, the timing controller TCON transmits display data and a read command in a display period (operation S213). The timing controller TCON may transmit packet data including the display data. The read command may be included in one configuration field included in the transmitted packet data.

The source driver SD receives data, i.e., the packet data (operation S224). The source driver SD may drive a display panel based on the display data included in the received packet data. When the read command is included in the packet data, the source driver SD transmits the parameter value to the timing controller TCON in response to (i.e., based on) the read command (operation S225). The source driver SD may transmit the parameter value through the share back channel SBC. The timing controller TCON stores the received parameter value in an internally provided storage (operation S214). Thereafter, the source driver SD may continue to receive the data from the timing controller TCON.

While the source driver SD is receiving the data, a receive abnormal state in which the receiving unit of the source driver SD does not normally receive the data, in other words, an abnormal state (e.g., a soft fail) occurs (operation S226). The source driver SD transmits an abnormal state occurrence signal to the timing controller TCON (operation S227). The source driver SD may transmit a state information signal of a first level, e.g., logic low, as the abnormal state occurrence signal through the share back channel SBC.

If the abnormal state information signal is received, the timing controller TCON determines that the source driver SD is to perform initialization and transmits a training pattern to the source driver SD (operation S215).

The source driver SD performs second initialization (operation S228). The source driver SD performs CDR training based on the training pattern, thereby recovering system clocks. The system clocks may be recovered, and thus the source driver SD may receive the data.

If the source driver SD is in a data receive state, the timing controller TCON transmits the parameter value to the source driver SD (operation S216). The source driver SD optimizes the receiving operation based on the received parameter value (operation S229). The source driver SD may store the received parameter value in the register and apply the parameter value to the receiving unit, thereby optimizing the receiving operation. After the receiving operation is optimized, the source driver SD receives the data, i.e., the packet data including the display data, from the timing controller TCON (operation S224).

In example embodiments, the timing controller 210 may transmit a reset signal or a synchronization signal to the source driver SD through the share forward channel SFC of FIG. 16. The source driver SD may perform a reset operation in response to (i.e., based on) the reset signal or the synchronization signal. In this regard, the source driver SD may perform second initialization. The timing controller TCON may transmit a training pattern to the source driver SD. The source driver SD may perform CDR training based on the training pattern. After the reset operation, i.e., second initialization, is performed, the source driver SD may receive the packet data including the display data.

In the method of operating the display driving circuit according to the example embodiments, the first initialization operation (S222) and the operation of storing the parameter value (S223) may be performed in a first initialization operation after power is supplied to the display driving circuit.

In example embodiments, the first initialization operation (S222) and the operation of storing the parameter value (S223) may be performed periodically at a preset time units or intervals after first initialization is performed. As shown, the timing controller TCON counts an elapsed time (operation S217) and controls the plurality of source drivers 220-1 through **220-*n* to perform the first initialization operation (S222) and the operation of storing the parameter value (S223**) at the preset time units or intervals.

In example embodiments, after first initialization is performed, the first initialization operation (S222) and the operation of storing the parameter value (S223) may be performed according to a preset condition. For example, the source driver SD may perform the second initialization operation (S228) and the optimization operation (S229) k (k is an integer greater than or equal to 2) times according to occurrence of the soft fail, and may perform the first initialization operation (S222) and the operation of storing the parameter value (S223) when a next soft fail occurs. For another example, if the soft fail occurs k times in a preset time period, the source driver SD may perform the first initialization operation (S222) and the operation of storing the parameter value (S223) in response to (i.e., based on) a kth soft fail. The timing controller TCON may count a soft fail occurrence number and may control the plurality of source drivers 220-1 through **220-*n* to perform the first initialization operation (S222) and the operation of storing the parameter value (S223**) based on a counting number.

For convenience of description, a method of interfacing the timing controller TCON and one source driver SD is illustrated in FIG. 17. As shown in FIGS. 2 and 11, the display driving circuit may include a plurality of source drivers, and methods of operating the plurality of source drivers are similar to each other. Thus, the method of FIG. 17 may be applied to methods of interfacing the timing controller 210 and the plurality of source drivers.

Figure 18:
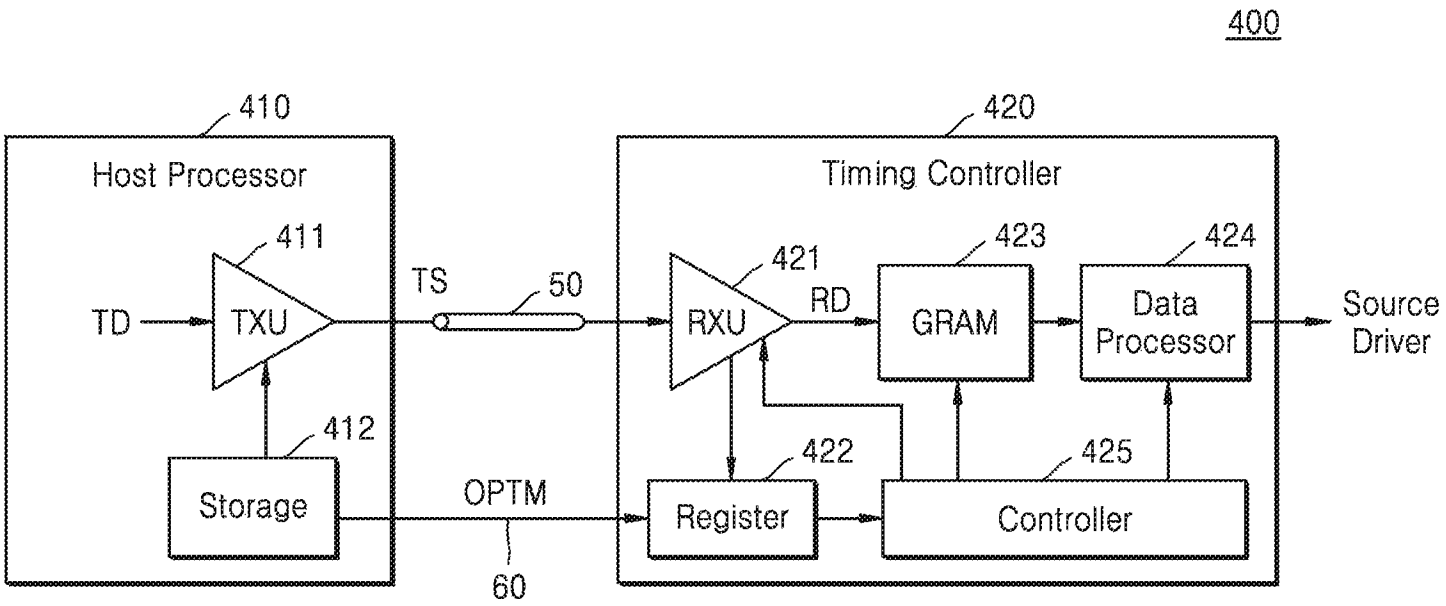
FIG. 18 is a block diagram of a display system according to example embodiments.

FIG. 18 is a block diagram of a display system 400 according to example embodiments.

Referring to FIG. 18, the display system 400 includes a host processor 410 and a timing controller 420. The transmitting and receiving system 100 and the method of operating the transmitting and receiving system 100 described with reference to FIG. 1 above may be applied to the display system. The transmitter 110 of the transmitting and receiving system 100 may be applied to the host processor 410. The receiver 120 of the transmitting and receiving system 100 may be applied to the timing controller 420.

The host processor 410 transmits display data to the timing controller 420 as the transmission data TD. For example, the host processor 410 may be an application processor of an electronic device on which the display system 400 is mounted. The host processor 410 includes a transmission unit 411 (TXU) and a storage 412.

The transmission unit 411 converts the transmission data TD into a transmission signal TS according to a set interface scheme and characteristics of a data transmission channel 50 and provides the transmission signal TS to the data transmission channel 50. The transmission unit 411 may convert the transmission data TD into packet data.

The storage 412 may store various types of data for an operation of the transmission unit 411. The storage 412 may also store data provided from the timing controller 420. In the example embodiments, the storage 412 may store the parameter value OPTM of the receiving unit 421 transmitted from the timing controller 420.

The timing controller 420 receives the data transmitted from the host processor 410, may perform image processing on display data included in the received data, and may provide the display data to a source driver.

The timing controller 420 includes a receiving unit 421 (RXU), a register 422, a frame memory 423 (GRAM), a data processor 424, and a controller 425. The receiving unit 421 receives the transmission signal TS transmitted through the data transmission channel 50 and may recover the data from the transmission signal TS. Display data included in the recovered data RD may be stored in the frame memory 423.

The receiving unit 421 may recover a system clock through training and perform an optimization operation for improving a receiving performance. The receiving unit 421 may determine the parameter value OPTM optimizing the receiving operation. In example embodiments, after power is supplied, the receiving unit 421 may determine the parameter value OPTM through training in a first initialization period. In example embodiments, the receiving unit 421 may determine the parameter value OTPM periodically at a preset time period. The determined parameter value OPTM may be stored in the register 422.

The frame memory 423 may store display data corresponding to one frame of an image. The frame memory 423 may be implemented as one among various types of memory such as DRAM (dynamic random access memory), SRAM (static RAM), flash memory, ReRAM (resistance RAM), MRAM (magnetic RAM), etc.

The data processor 424 may perform image processing on the display data output from the frame memory 423. For example, the data processor 424 may perform image processing for compensating for quality of a displayed image or may modify the display data to correspond to a type of a display panel. The image processed data may be transmitted to the source driver.

The register 422 may store the parameter value OPTM. The register 422 may store configuration data included in the recovered data RD for controlling the timing controller 420 or the source driver.

The controller 425 may control the overall operation of the timing controller 420. The controller 425 may control the receiving unit 421 to perform one among first initialization and second initialization. In example embodiments, the controller 425 may control a receiving operation of the receiving unit 421 based on an initialization control signal included in control data transmitted from the hot processor 410.

The timing controller 420 may transmit the parameter value OPTM stored in the register 422 to the host processor 410. In example embodiments, the timing controller 420 transmits the parameter value OPTM to the host processor 410 through a state transmission channel 60.

The host processor 410 may store the received parameter value OPTM in the storage 412 and then, if a receive state of the timing controller 420 is determined to be defective, may re-transmit the parameter value OPTM to the timing controller 420. In this regard, the timing controller 420 may optimize the receiving unit 421 based on the received parameter value OPTM without training.

Figure 19:
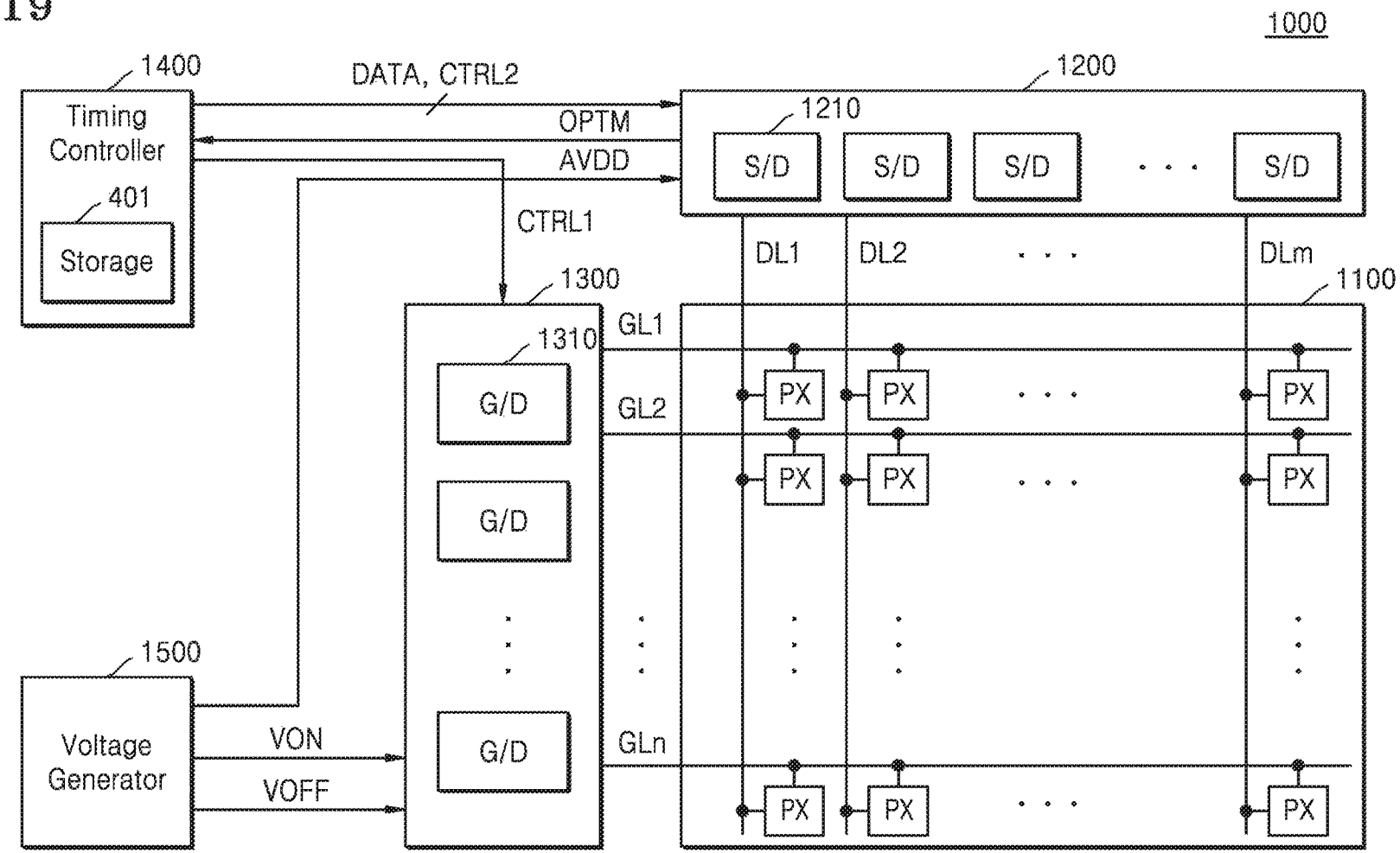
FIG. 19 is a block diagram of a display device including a display driving circuit, according to example embodiments.

FIG. 19 is a block diagram of a display device 1000 including a display driving circuit, according to example embodiments.

Referring to FIG. 19, the display device 1000 includes a display panel 1100 displaying an image and the display driving circuit driving the display panel 1100. The display driving circuit includes a source driver 1200 driving first to data lines DL1~DLm of the display panel 1100, a gate driver 1300 driving gate lines GL1~GLn of the display panel 1100, and a timing controller 1400 generating various timing signals and data DATA, CTRL2, and CTRL1. The display device 1000 further includes a voltage generator 1500 generating various voltages VON, VOFF, and AVDD that are for display driving.

The display device 1000 may be applied to any one among various flat panel display devices. For example, flat panel display devices may include a liquid crystal display (LCD), an organic light-emitting diode (OLED) display, a plasma display panel (PDP), and the like. The display device 1000 according to the example embodiments may be applied to any one among the flat panel display devices. For convenience of description, hereinafter, an LCD device will be described as an example.

The display panel 1100 includes the gate lines GL1~GLn, the data lines DL1 DLm arranged in a direction crossing the gate lines GL1~GLn, and pixels PX arranged at locations where the gate lines GL1~GLn and the data lines DL1~DLm cross each other. When the display device 1000 is an LCD device, each pixel PX of the display device 1000 may include a transistor including a gate electrode and a source electrode respectively connected to a gate line and a data line, an LCD capacitor connected to a drain electrode of the transistor, and a storage capacitor.

The source driver 1200 may include one or more source drivers 1210. For example, when the display panel 1100 has a large size, a plurality of source drivers 1210 may be provided, and one or more data lines may be driven by the source drivers 1210. The gate driver 1300 may also include one or more gate drivers 1310, and one or more gate lines may be driven by the gate drivers 1310.

The voltage generator 1500 may receive a power supply voltage VDD from the outside and generate various voltages for an operation of the display device 1000. For example, the voltage generator 1500 may generate a gate-on voltage VON and a gate-off voltage VOFF, outputs the gate-on voltage VON and the gate-off voltage VOFF to the gate driver 1300, may generate an analog power supply voltage AVDD, and outputs the analog power supply voltage AVDD to the source driver 1200.

The timing controller 1400 may receive external data I_DATA, a horizontal synchronization signal H_SYNC, a vertical synchronization signal V_SYNC, a clock signal MCLK, a data enable signal DE, and the like from an external device (or an external host processor). The timing controller 1400 may generate display data DATA in which a protocol is converted to correspond to an interface method with the source driver 1200, and outputs the display data DATA to the source driver 1200. The timing controller 1400 may also generate various control signals CTRL1 and CTRL2 for controlling timing of the source driver 1200 and the gate driver 1300, outputs one or more first control signals CTRL1 to the gate driver 1300, and outputs one or more second control signals CTRL2 to the source driver 1200.

The display data DATA and the one or more second control signals CTRL2 that are output from the timing controller 1400 may be provided to the source driver 1200 through a data transmission channel. Although FIG. 19 shows only one line between the timing controller 1400 and the source driver 1200, the display data DATA and the one or more second control signals CTRL2 that are output from the timing controller 1400 may be substantially provided to each of the source drivers 1210 through a plurality of data transmission channels as shown in FIG. 2. In this regard, lengths of the data transmission channels that transmit signals between the timing controller 1400 and the source drivers 1210 may be different from each other. When a panel size of the display panel 1100 is relatively large, the lengths of the data transmission channels may increase, and thus, a transmission error may occur due to a signal distortion during signal transmission.

To prevent the transmission error, each of the source drivers 1210 may perform DC training and AC training according to impedance and frequency characteristics of a data transmission channel corresponding to a partial initialization period. The source drivers 1210 may determine the parameter value OPTM of a receiving unit optimizing a receiving operation through training.

The source drivers 1210 transmits the determined parameter value OPTM to the timing controller 1400, and thus the parameter value OPTM may be stored in a storage 401 of the timing controller 140. Thereafter, when a receive abnormal state occurs in the source drivers 1210, the source drivers 1210 may optimize the receiving operation of the receiving unit based on the parameter value OPTM provided from the timing controller 1400. A training operation of determining the parameter value OPTM may be minimized, thereby reducing time consumed to optimize receiving operations of the source drivers 1210 and improving receive efficiency of the source drivers 1210.

Figure 20:
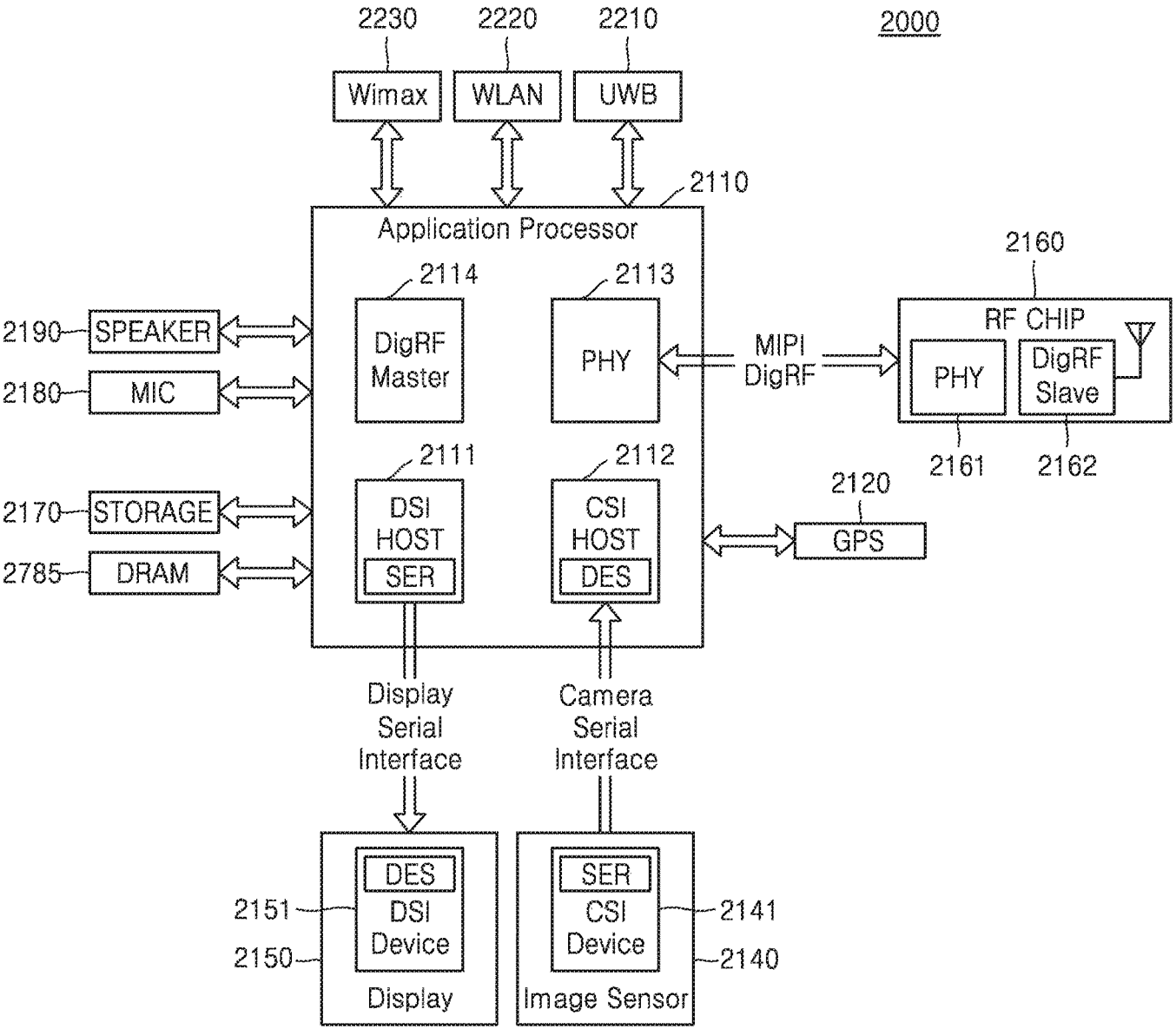
FIG. 20 is a block diagram of an electronic system according to example embodiments.

FIG. 20 is a block diagram of an electronic system 2000 according to example embodiments.

Referring to FIG. 20, the electronic system 2000 may be implemented as a mobile phone, a personal digital assistant (PDA), a portable multimedia player (PMP), or a smart phone.

The electronic system 2000 may include an application processor 2110, a display device 2150, and an image sensor. A display serial interface (DSI) host 2111 implemented in the application processor 2110 may serially communicate with a DSI device 2151 of the display device 2150 through a DSI.

A camera serial interface (CSI) host 2112 implemented in the application processor 2110 may serially communicate with a CSI device 2141 of the image sensor 2140 through a CSI.

The method of operating the transmitting and receiving system 100 of FIG. 1 may be applied to a method of interfacing the DSI host 2111 and the DSI device 2151 or a method of interfacing the CSI host 2112 and the CSI device 2141.

The electronic system 2000 may further include a radio frequency (RF) chip 2160 that may communicate with the application processor 2110. A physical layer protocol (PHY) 2113 of the electronic system 2000 and a PHY 2161 of the RF chip 2160 may transmit and receive data to and from each other according to a MIPI DigRF interface.

The electronic system 2000 may further include a global positioning system (GPS) 2120, a storage 2170, a microphone 2180, a DRAM 2185, and a speaker 2190. The electronic system 2000 may perform communication by using a Wimax 2230, a wireless local area network (WLAN) 2220, and an ultra wideband (UWB) 2210.

At least one among the components, elements, modules or units represented by a block as illustrated in FIGS. 1 to 2, 6 to 9, 15 to 16, and 18 to 20 may be embodied as various numbers of hardware, software and/or firmware structures that execute respective functions described above, according to the example embodiments. For example, at least one among these components, elements, modules or units may use a direct circuit structure, such as a memory, a processor, a logic circuit, a look-up table, etc. that may execute the respective functions through controls of one or more microprocessors or other control apparatuses. Also, at least one among these components, elements, modules or units may be embodied by a module, a program, or a part of code, which contains one or more executable instructions for performing specified logic functions, and executed by one or more microprocessors or other control apparatuses. Also, at least one among these components, elements, modules or units may further include or may be implemented by a processor such as a central processing unit (CPU) that performs the respective functions, a microprocessor, or the like. Two or more of these components, elements, modules or units may be combined into one single component, element, module or unit that performs all operations or functions of the combined two or more components, elements, modules or units. Also, at least part of functions of at least one among these components, elements, modules or units may be performed by another of these components, elements, modules or units. Further, communication between the components, elements, modules or units may be performed through the bus. Functional aspects of the above example embodiments may be implemented in algorithms that execute on one or more processors. Furthermore, the components, elements, modules or units represented by a block or processing steps may employ any number of related art techniques for electronics configuration, signal processing and/or control, data processing and the like.

Although a few example embodiments have been shown and described, it would be appreciated by those skilled in the art that changes may be made in the example embodiments without departing from the principles and spirit of the disclosure, the scope of which is defined in the claims and their equivalents.

What is claimed is:

1. A method of operating a source driver comprising a receiver that comprises a receiving circuit that receives an input signal from a data transmission channel between the source driver and a timing controller, and an equalizer connected to an output of the receiving circuit, the method comprising:

performing, by the source driver, first training to obtain a plurality of parameter values of the receiver for optimizing a receiving of the receiver, wherein the plurality of parameter values comprises any combination including two or more of:

a first parameter value for matching an input impedance of the receiving circuit to the data transmission channel;

a second parameter value for compensating an offset of the receiving circuit; and a third parameter value that is applied to the equalizer to adjust a gain of the input signal of the receiver;

performing, by the source driver, second training to recover a system clock of the receiver;

transmitting, by the source driver, the obtained plurality of parameter values, to the timing controller;

based on an abnormal state occurring in the receiving of the receiver, re-performing, by the source driver, the second training to recover the system clock of the receiver;

receiving, by the source driver, the plurality of parameter values previously transmitted to the timing controller, from the timing controller; and applying, by the source driver, the received plurality of parameter values to the receiver, to optimize the receiving of the receiver without re-performing the first training.

2. The method of claim 1, wherein the plurality of parameter values is obtained in a first initialization period, based on power being supplied to the source driver.

3. The method of claim 1, wherein the plurality of parameter values is obtained periodically at preset time intervals.

4. The method of claim 1, further comprising receiving a read command for the plurality of parameter values from the timing controller through the data transmission channel, after the first training is performed, wherein the obtained plurality of parameter values is transmitted in response to the receiving the read command.

5. The method of claim 1, further comprising converting the obtained plurality of parameter values into packet data, wherein the transmitting the plurality of parameter values comprises transmitting, to the timing controller, the packet data through a state transmission channel between the source driver and the timing controller.

6. The method of claim 1, wherein the obtained plurality of parameter values is transmitted in a display period.

7. The method of claim 6, further comprising receiving, by the source driver, display data from the timing controller through the data transmission channel in the display period, wherein the obtained plurality of parameter values is transmitted through a state transmission channel different from the data transmission channel in the display period.

8. The method of claim 7, further comprising, based on the abnormal state occurring, transmitting a state information signal indicating the abnormal state to the timing controller through the state transmission channel.

9. The method of claim 1, wherein the first parameter value is a resistance level of variable resistors respectively connected to input ends of the receiving circuit, and wherein the second parameter value is a voltage level of an offset compensation voltage that is provided to one of the input ends of the receiving circuit.

10. The method of claim 1, wherein the second parameter value is a voltage level of an offset compensation voltage that is provided to one input end of the receiving circuit, and wherein the third parameter value is an equalization coefficient that is applied to an output value of the equalizer, to obtain a negative-feedback value that is applied to an input signal of the equalizer.

11. The method of claim 1, wherein the first parameter value is a resistance level of variable resistors respectively connected to input ends of the receiving circuit, wherein the second parameter value is a voltage level of an offset compensation voltage that is provided to one of the input ends of the receiving circuit, and wherein the third parameter value is an equalization coefficient that is applied to an output value of the equalizer, to obtain a negative-feedback value that is applied to an input signal of the equalizer.

12. A display driving circuit comprising:

a source driver comprising a receiver, wherein the receiver comprises:

a receiving circuit connected to a first channel for receiving display data; and an equalizer that comprises an input end connected to an output end of the receiving circuit, wherein the source driver is configured to perform a first training to obtain a plurality of parameter values for optimizing a receiving of the receiver and a second training to obtain a system clock of the receiver; and a timing controller configured to:

receive the plurality of parameter values through a second channel from the source driver; and based on an abnormal state occurring in the receiving of the source driver, transmit the plurality of parameter values that is previously received from the source driver, to the source driver through the first channel, and wherein the source driver is further configured to, based on the abnormal state occurring in the receiving of the source driver, re-perform the second training, receiving the plurality of parameter values from the timing controller, and apply the received plurality of parameter values to the receiver, to optimize the receiving of the receiver without re-performing the first training.

13. The display driving circuit of claim 12, wherein the source driver is further configured to:

receive, from the timing controller, a read command for the plurality of parameter values after the first training is performed, and transmit the plurality of parameter values to the timing controller based on the reception of the read command.

14. The display driving circuit of claim 12, wherein the plurality of parameter values comprises any combination including two or more of:

a resistance level of variable resistors respectively connected to input ends of a comparator comprised in the receiver;

a voltage level of an offset compensation voltage that is provided to one of the input ends of the comparator; and an equalization coefficient that is applied to an feedback filter of the equalizer.

15. The display driving circuit of claim 14, wherein the comparator is configured to receive a differential signal pair from the timing controller through the first channel, wherein the source driver further comprises an offset compensation circuit configured to provide the offset compensation voltage to the one of the input ends of the comparator, and wherein the equalizer is configured to adjust a gain of an input signal using the feedback filter to compensate for a distortion of the input signal due to the first channel.

16. The display driving circuit of claim 12, wherein the source driver is further configured to transmit a state information signal indicating the abnormal state to the timing controller through the second channel.

17. A system for a display panel, the system comprising:
a transmitter; and
a receiver comprising:
a comparator that comprises input ends connected to a data transmission channel; and
an equalizer that comprises an input end connected to an output end of the receiver,
wherein the receiver is configured to:
perform first training to obtain a plurality of parameter values for optimizing a receiving of the receiver, wherein the plurality of parameter values comprises any combination including two or more of:
a resistance level of variable resistors for matching an input impedance of the comparator to the data transmission channel;
a voltage level of an offset compensation voltage for compensating an offset of the comparator; and
an equalization coefficient that is applied to the equalizer;
perform second training to obtain a system clock of the receiver;
receive a read command for the plurality of parameter values from the transmitter, after the first training is performed;
transmit the obtained plurality of parameter values to the transmitter in response to the read command being received; and
based on an abnormal state occurring in the receiving of the receiver, transmit, to the transmitter, a state information signal indicating the abnormal state of the receiving of the receiver,
wherein the transmitter is configured to, based on the state information signal indicating a data receiving state being received from the receiver, transmit, to the receiver, the plurality of parameter values that is received from the receiver, and
wherein the receiver is further configured to, based on the abnormal state occurring in the receiving of the receiver, re-perform the second training, receiving the plurality of parameter values from the transmitter, and apply the received plurality of parameter values to the receiver, to optimize the receiving of the receiver without re-performing the first training.

18. The system of claim 17, wherein the transmitter is a timing controller of the display panel, the timing controller being configured to transmit, to the receiver, a reset signal and a frame synchronization signal, and
wherein the receiver is a source driver of the display panel, the source driver being configured to transmit, to the timing controller, the state information signal indicating the data receiving state, based on the reset signal or the frame synchronization signal being transmitted.

19. The system of claim 17, wherein the transmitter is a processor of a device on which the display panel is disposed, and
wherein the receiver is a timing controller of the display panel, the timing controller being connected to a source driver of the display panel.

* * * * *